US008678797B2

(12) United States Patent
Kawano et al.

(10) Patent No.: US 8,678,797 B2
(45) Date of Patent: Mar. 25, 2014

(54) VARIABLE DISPLACEMENT SCROLL COMPRESSOR HAVING FIRST AND SECOND COMPRESSION CHAMBERS THAT COMMUNICATE WITH EACH OTHER

(75) Inventors: Shigeru Kawano, Chiryu (JP); Masami Sanuki, Chiryu (JP); Takahiro Ishihara, Okazaki (JP)

(73) Assignee: DENSO CORPORATION, Kariya (JP)

( * ) Notice: Subject to any disclaimer, the term of this patent is extended or adjusted under 35 U.S.C. 154(b) by 26 days.

(21) Appl. No.: 13/281,586

(22) Filed: Oct. 26, 2011

(65) Prior Publication Data

US 2012/0107164 A1 May 3, 2012

(30) Foreign Application Priority Data

Nov. 3, 2010 (JP) ..... 2010-246949

(51) Int. Cl.
*F03C 2/00* (2006.01)
*F03C 4/00* (2006.01)

(52) U.S. Cl.
USPC ..... 418/55.2; 418/15; 418/55.1; 418/55.5; 418/57

(58) Field of Classification Search
USPC ..... 418/55.1–55.6, 57.27, DIG. 1, 15
See application file for complete search history.

(56) References Cited

U.S. PATENT DOCUMENTS 4,505,651 A 3/1985 Terauchi et al.
5,074,760 A * 12/1991 Hirooka et al. ..... 418/55.1
6,139,287 A 10/2000 Kuroiwa et al.
6,164,940 A * 12/2000 Terauchi et al. ..... 418/55.1
7,344,365 B2 * 3/2008 Takeuchi et al. ..... 418/55.2

FOREIGN PATENT DOCUMENTS

JP A-62-029784 2/1987
JP B2-2679228 8/1997
JP A-H11-315792 11/1999
JP 2001-221174 8/2001
JP 2009036140 A * 2/2009 ..... F04C 18/02
JP A-2010-121577 6/2010

OTHER PUBLICATIONS

Office Action mailed Oct. 30, 2012 in corresponding JP Application No. 2010-246949 (and English translation).
Office Action mailed Sep. 3, 2013 in the corresponding JP application No. 2012-282667 (Division application of JP No. 2010-246949) (English translation attached).

* cited by examiner

*Primary Examiner* — Theresa Trieu
(74) *Attorney, Agent, or Firm* — Posz Law Group, PLC

(57) ABSTRACT

A stationary base plate includes a sub-bypass hole, which communicates between a suction chamber and a first compression chamber, and a main bypass hole, which communicates between the suction chamber and a second compression chamber. A rotational center of the orbiting scroll and the sub-bypass hole are located along a first imaginary line. The rotational center of the orbiting scroll is also located along a second imaginary line, which is perpendicular to the first imaginary line. The main bypass hole opens at a location of the stationary base plate, which is on a side of the second imaginary line where the sub-bypass hole is located, so that timing of communicating between the suction chamber and the first compression chamber with each other is deviated from timing of communicating between the suction chamber and the second compression chamber with each other.

8 Claims, 14 Drawing Sheets

VARIABLE DISPLACEMENT SCROLL COMPRESSOR HAVING FIRST AND SECOND COMPRESSION CHAMBERS THAT COMMUNICATE WITH EACH OTHER

CROSS REFERENCE TO RELATED APPLICATION

This application is based on and incorporates herein by reference Japanese Patent Application No. 2010-246949 filed on Nov. 3, 2010.

BACKGROUND OF THE INVENTION

1. Field of the Invention

The present invention relates to a variable displacement scroll compressor.

2. Description of Related Art

In a case of a known prior art scroll compressor, a stationary scroll and an orbiting scroll contact with each other, and refrigerant is compressed in each of two closed spaces (compression chambers), which are defined between the stationary scroll and the orbiting scroll. In this scroll compressor, the orbiting scroll revolves multiple times (e.g., twice) relative to the stationary scroll, so that the refrigerant, which is drawn into each of the compression chamber, is compressed. In comparison to a reciprocal compressor, the compression of the refrigerant is moderate in the scroll compressor, and thereby leakage of the refrigerant from each compression chamber is small in the scroll compressor.

One such a scroll compressor is known as a variable displacement scroll compressor (see, for example, JPS59-028083A, which corresponds to U.S. Pat. No. 4,505,651A). In the known variable displacement compressor, two bypass holes are symmetrically placed about a rotational center (also referred to as an orbital center or a revolution center) of the orbiting scroll, about which the orbiting scroll revolves relative to the stationary scroll. During a compression stroke for compressing the refrigerant, the refrigerant of each of the two compression chambers, which are formed through the contact between the stationary scroll and the orbiting scroll, is returned to a suction chamber through the corresponding one of the two bypass holes, so that a displacement (i.e., a volume of refrigerant, which is displaced, i.e., discharged per cycle) is changed, i.e., is varied. The two compression chambers are formed as closed spaces and are placed on one side and the other side, respectively, of a winding center of the scrolls. Specifically, one of the two compression chambers is defined by an inner peripheral wall surface of the stationary scroll (more specifically, a stationary wrap of the stationary scroll) and an outer peripheral wall surface of the orbiting scroll (more specifically, an orbiting wrap of the orbiting scroll), and the other one of the two compression chambers is defined between an outer peripheral wall surface of the stationary scroll and an inner peripheral wall surface of the orbiting scroll.

As in the case of the variable displacement scroll compressor of JPS59-028083A (corresponds to U.S. Pat. No. 4,505,651A), in which the two bypass holes are symmetrically placed about the rotational center of the orbiting scroll, the refrigerant of the one compression chamber and the refrigerant of the other compression chamber are returned to the suction chamber through the two bypass holes, respectively, at the same timing. Thereby, a compression stroke (a compression process or a compression period) of the compressor is shortened, and thereby the number of turns of the winding of each scroll is actually reduced.

For example, in a case of the variable displacement scroll compressor, in which the orbiting scroll revolves twice to compress the refrigerant drawn into the corresponding compression chamber at the time of operating the compressor at a maximum displacement (100% displacement), i.e., at a maximum displacement operational mode, when this variable displacement scroll compressor is operated at a variable displacement, i.e., at a variable displacement operational mode, the orbiting scroll may revolve once to compress and discharge the drawn refrigerant. Therefore, in the variable displacement operational mode, the compression stroke (the compression process or the compression period) of the compressor for compressing the fluid, i.e., the refrigerant is reduced.

In such a variable displacement scroll compressor, the compression of the refrigerant at the variable displacement operational mode is not moderate (i.e., is rapid), and thereby the refrigerant of each compression chamber may possibly leak from the compression chamber to result in a reduction in compression efficiency of the compressor at the time of operating the compressor at the variable displacement operational mode.

SUMMARY OF THE INVENTION

The present invention is made in view of the above disadvantage.

According to the present invention, there is provided a variable displacement scroll compressor, which includes a stationary scroll, an orbiting scroll, a suction chamber and a fluid discharge port. The stationary scroll includes a first base plate and a stationary wrap. The stationary wrap is spirally wound in a winding direction thereof along a plane of the first base plate and projects from the first base plate in a direction generally perpendicular to the plane of the first base plate. The orbiting scroll includes a second base plate and an orbiting wrap. The orbiting wrap is spirally wound in a winding direction thereof along a plane of the second base plate and projects from the second base plate toward the first base plate in a direction generally perpendicular to a plane of the second base plate. The stationary wrap and the orbiting wrap contact with each other to define first and second compression chambers between the stationary wrap and the orbiting wrap. The suction chamber is formed in a radially outermost portion of the orbiting scroll and is adapted to supply fluid to each of the first and second compression chambers. The fluid discharge port is formed in a center portion of the first base plate and is adapted to discharge the fluid from each of the first and second compression chambers toward an outside of the variable displacement compressor upon compression of the fluid in each of the first and second compression chambers. The first base plate includes a first bypass hole and a second bypass hole. The first bypass hole is adapted to communicate between the suction chamber and the first compression chamber, which is defined between an outer peripheral wall surface of the stationary wrap and an inner peripheral wall surface of the orbiting wrap. The second bypass hole is adapted to communicate between the suction chamber and the second compression chamber, which is defined between an inner peripheral wall surface of the stationary wrap and an outer peripheral wall surface of the orbiting wrap. A rotational center of the orbiting scroll, about which the orbiting scroll is adapted to revolve, and the first bypass hole are located along a first imaginary line in the plane of the first base plate. The rotational center of the orbiting scroll is also located along a second imaginary line, which is perpendicular to the first imaginary line in the plane of the first base plate. The second bypass hole opens at a corresponding location of the first base plate, which is on a side of the second imaginary line where the first bypass hole is located in the plane of the first base plate, so that timing of communicating between the suction chamber and the first compression chamber with each other through the first bypass hole is deviated from timing of communicating between the suction chamber and the second compression chamber with each other through the second bypass hole.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
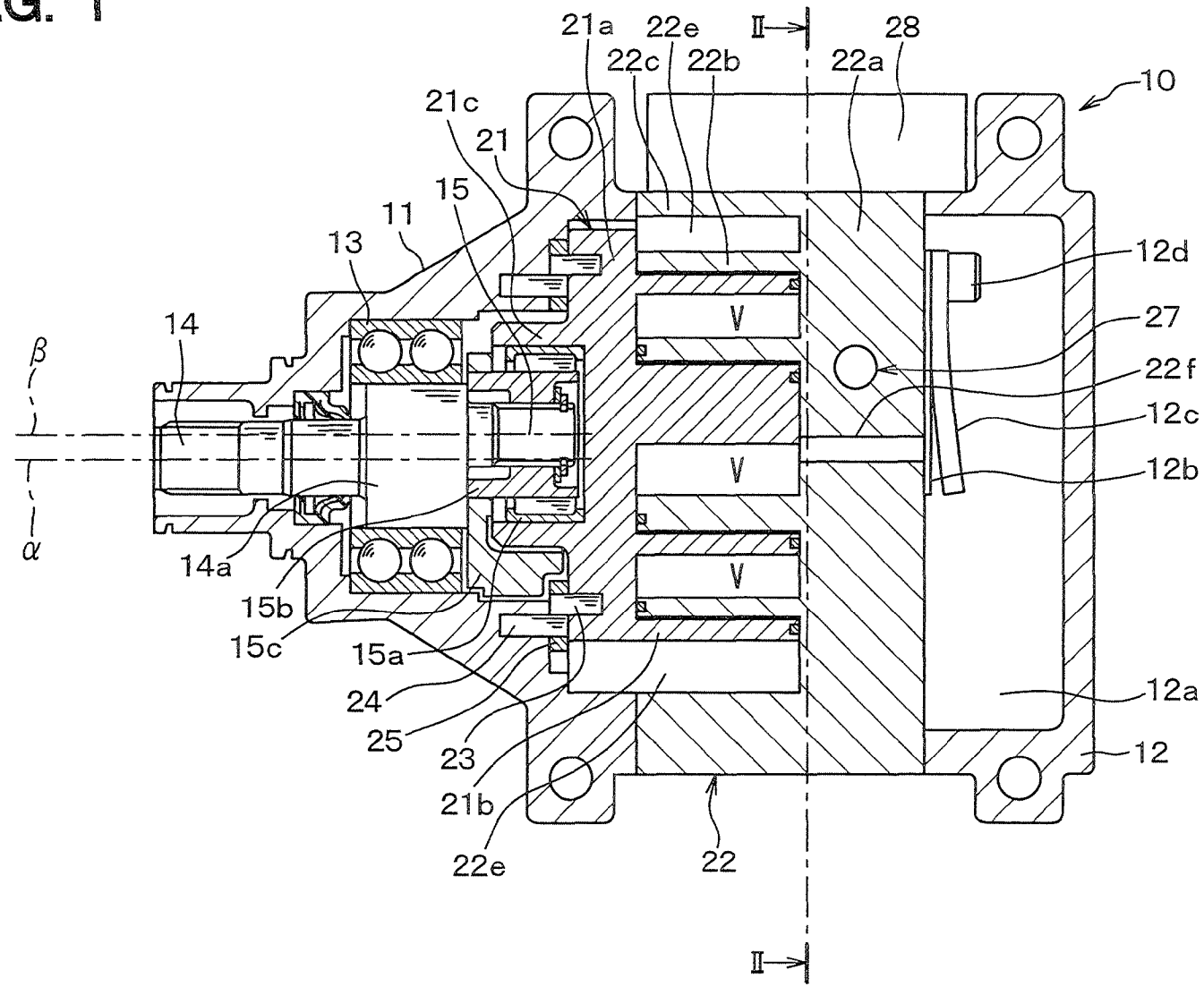
FIG. 1 is a longitudinal cross-sectional view of a variable displacement scroll compressor according to a first embodiment of the present invention.

Various embodiments of the present invention will be described with reference to the accompanying drawings. In each of the following embodiments, similar components are indicated by the same reference numerals.

First Embodiment

A first embodiment of the present invention will be described with reference to FIGS. 1 to 12. A variable displacement scroll compressor 10 (hereinafter simply referred to as a compressor 10) according to the present embodiment is used as a refrigerant compressor of a vehicle air conditioning system installed in a vehicle (e.g., an automobile). The vehicle air conditioning system is a known vapor compression refrigeration system (a refrigeration cycle), in which refrigerant is circulated through the compressor 10, a radiator, an expansion valve and an evaporator in this order. When the refrigerant is evaporated at the evaporator, the refrigerant takes heat from the air to be blown into a passenger compartment of the vehicle to cool the air, and this cooled air is then blown into the passenger compartment to cool the same. The refrigerant may be chlorofluorocarbon refrigerant. Alternatively, the refrigerant may be hydrocarbon (HC), carbon dioxide or the like.

In the refrigeration cycle, the compressor 10 draws the refrigerant and discharges the drawn refrigerant upon compressing the same. The compressor 10 is driven by a drive engine of the vehicle (hereinafter simply referred to as an engine) through a drive force conducting device (drive force conducting means), such as a V-belt, a pulley or an electromagnetic clutch.

Figure 2:
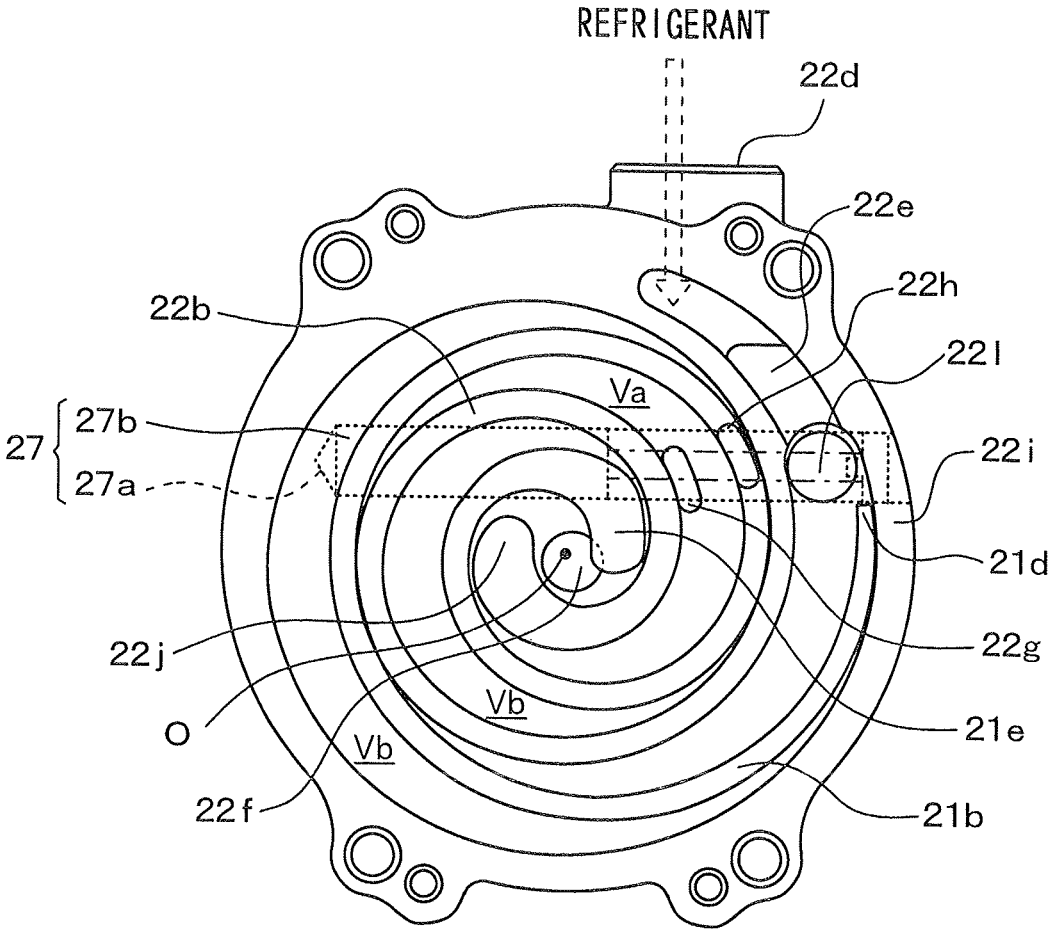
FIG. 2 is a cross-sectional view taken along line II-II in FIG. 1.

Detail of the compressor 10 will be described with reference to FIGS. 1 and 2. FIG. 1 is a longitudinal cross-sectional view of the compressor 10 of the present embodiment, and FIG. 2 is a cross-sectional view taken along line II'-II in FIG. 1.

As shown in FIG. 1, the compressor 10 includes a front housing 11 and a rear housing 12, which are made of an aluminum alloy.

In the front housing 11, a shaft 14 is rotatably supported by a bearing 13. The shaft 14 is driven by a rotational drive force of the engine through the electromagnetic clutch (not shown), so that the shaft 14 is rotated about a rotational axis α. A rotational speed of the shaft 14 is variable depending on a rotational speed of the engine.

A rear housing 12 side portion of the shaft 14, which is radially opposed to the bearing 13, is formed as a large diameter portion 14*a*. A crankshaft 15, which projects toward the rear housing 12 side, is joined to a rear housing 12 side end surface of the large diameter portion 14*a* of the shaft 14 by coupling (a coupling means), such as press fitting.

The crankshaft 15 is connected to the large diameter portion 14*a* of the shaft 14 at an eccentric location on the large diameter portion 14*a*, at which a central axis β of the crankshaft 15 is eccentric to the rotational axis a of the shaft 14. An orbiting scroll 21 is rotatably connected to an outer peripheral wall surface of the crankshaft 15 through a bearing 15*a* and a bush 15*b*.

A balance weight 15*c* is provided to the crankshaft 15 at a location which is radially opposite to a crankshaft 15 about the rotational axis α. An eccentric force, which is applied to the crankshaft 15, is balanced with the balance weight 15*c*. In other words, a rotational unbalance, which is caused by the eccentricity of the crankshaft 15, is adjusted with the balance weight 15*c*.

The orbiting scroll 21 includes a planar orbiting base plate (a second base plate) 21*a*, a spirally wound orbiting wrap (also referred to as an orbiting tooth or blade) 21*b* and a connection 21*c*. The connection 21*c* is connected to the crankshaft 15. A plane of the orbiting base plate 21*a* is generally perpendicular to the rotational axis α. The orbiting wrap 21*b* is spirally wound in a winding direction thereof along the plane of the orbiting base plate 21*a* and projects from a rear housing 12 side end surface of the orbiting base plate 21*a* in a direction generally parallel to the rotational axis α, i.e., in a direction generally perpendicular to the plane of the orbiting base plate 21*a*. The orbiting wrap 21*b* is arranged to slidably contact and mesh with a stationary wrap (also referred to as a stationary tooth or blade) 22*b* of the stationary scroll 22 described later. In this particular embodiment, the number of turns of the orbiting wrap 21*b* is two, i.e., the orbiting wrap 21*b* is wound twice.

The connection 21*c*, which is connected to the crankshaft 15, is formed in a center potion of a shaft 14 side end surface of the orbiting base plate 21*a*. The crankshaft 15 is rotatably engaged with the connection 21*c* of the orbiting base plate 21*a* through the bearing 15*a* and the bush 15*b*.

A rotation limiting pin 23 is press fitted into the shaft 14 side end surface of the orbiting base plate 21*a* to limit rotation of the orbiting scroll 21 about a center of the orbiting scroll 21. Furthermore, a rotation limiting pin 24 is axially press fitted into an opposed part of the front housing 11, which is axially opposed to the orbiting base plate 21*a* and is adjacent to the rotation limiting pin 23. Each rotation limiting pin 23, 24 is arrested by an annular ring member 25. The rotation (self-rotation) of the orbiting scroll 21 about the center thereof is limited by the ring member 25 and the rotation limiting pins 23, 24. That is, the ring member 25 and the rotation limiting pins 23, 24 form a rotation limiting mechanism, which limits the rotation (self-rotation) of the orbiting scroll 21 about the center thereof.

Therefore, the rotation of the crankshaft 15, which is connected to the shaft 14, is conducted as an orbital motion of the orbiting scroll 21, which is engaged with the crankshaft 15, and thereby the orbiting scroll 21 orbits, i.e., revolves without rotating about the center thereof. In other words, when the shaft 14 is rotated, the orbiting scroll 21 orbits, i.e., revolves around the rotational axis α.

The stationary scroll 22 includes a planar stationary base plate (a first base plate) 22*a*, the spirally wound stationary wrap 22*b* and an outer peripheral portion 22*c*. The outer peripheral portion 22*c* serves as a connection, which is connected to the front housing 11. A plane of the stationary base plate 22*a* is generally perpendicular to the rotational axis α. The stationary wrap 22*b* is spirally wound in a winding direction thereof along the plane of the stationary base plate 22*a* and projects from a front housing 11 side end surface of the stationary base plate 22*a* in a direction generally parallel to the rotational axis α, i.e., in a direction generally perpendicular to the plane of the stationary base plate 22*a*.

As discussed above, the stationary wrap 22*b* contacts and meshes with the orbiting wrap 21*b*, so that two compression chambers (first and second compression chambers) Va, Vb, in each of which the refrigerant is compressed, are defined, i.e., are formed between the orbiting wrap 21*b* and the stationary wrap 22*b*. In the following description, these two compression chambers Va, Vb will be also collectively or individually referred to as a compression chamber V.

A refrigerant discharge port (also referred to as a fluid discharge port) 22*f*, which will be described later, is placed between the compression chambers Va, Vb. Furthermore, a volume (a cubic content) of the compression chamber Va is generally the same as a volume (a cubic content) of the compression chamber Vb. The volumes of the compression chambers Va, Vb, which are formed by the orbiting scroll 21 and the stationary scroll 22, are reduced to compress the refrigerant trapped therein in response to the orbiting motion of the orbiting scroll 21. In the present embodiment, for descriptive purpose, the closed space, which is defined between an outer peripheral wall surface of the stationary wrap 22*b* and an inner peripheral wall surface of the orbiting wrap 21*b*, will be referred to as the first compression chamber Va, and the closed space, which is defined between an inner peripheral wall surface of the stationary wrap 22*b* and an outer peripheral wall surface of the orbiting wrap 21*b* will be referred to as the second compression chamber Vb (see FIG. 2).

In a case where a winding start end portion (a radial inner end portion) 21*e* of the orbiting wrap 21*b* is adapted to contact a winding start end portion (a radial inner end portion) 22*j* of the stationary wrap 22*b* in the compressor 10, a pressure in each of the compression chambers Va, Vb may possibly be rapidly increased due to compression of the liquid refrigerant or oil accumulated at a location around the winding start end portions 21*e*, 21*j* in the compression chamber Va, Vb. At that time, a large bending stress is applied to a root of each wrap 21*b*, 22*b* to possibly cause deformation or damage of the wrap 21*b*, 22*b*.

In view of the above point, a wrap clearance (also referred to as a wrap-to-wrap clearance) 22*k* is formed to reduce a wrap wall width (thickness) of the stationary warp 22*b* (the wrap wall width of the stationary wrap 22*b* being measured in a direction perpendicular to an inner peripheral wall surface of the stationary wrap 22*b*) in a predetermined angular extent (a wrap clearance extent N) in the winding start end portion 22*j* of the stationary wrap 22*b*, which is opposed to the orbiting wrap 21*b*. Specifically, as shown in FIG. 3A, the wrap clearance 22*k* is formed in a contactable portion of the stationary wrap 22*b*, which is contactable with the orbiting wrap 21*b* when the orbiting scroll 21 is displaced through the orbiting motion thereof within an angular range of $-N \leq \theta o \leq N$ (N is equal to 90 degrees in the present embodiment). Here, θo denotes a rotational angle (a merge reference angle) of the orbiting scroll 21 at the time where the compression chambers Va, Vb are communicated with each other to merge the refrigerant of the compression chamber Va and the refrigerant of the compression chamber Vb together.

Figure 3B:
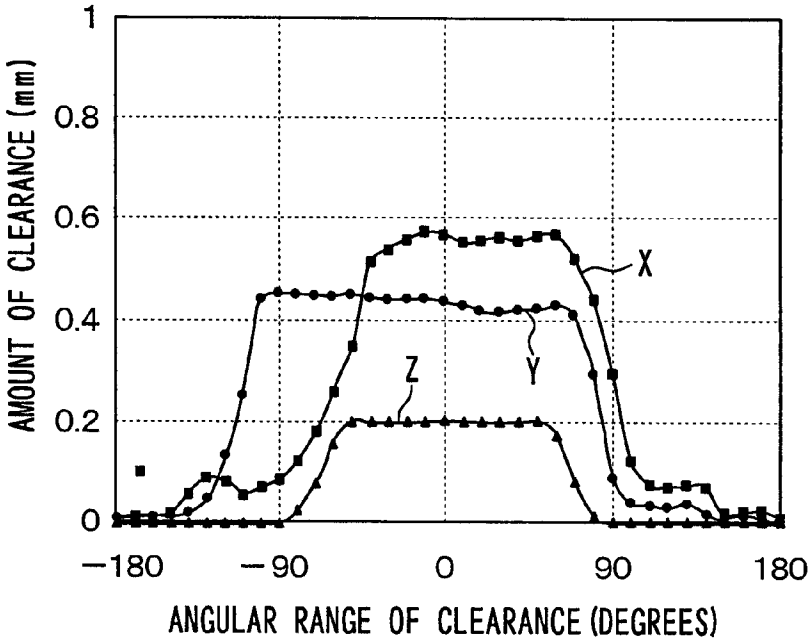
FIG. 3B is a diagram showing a relationship between an amount of clearance and an angular range of the clearance in the wrap clearance of the stationary wrap according to the first embodiment.
Figure 3A:
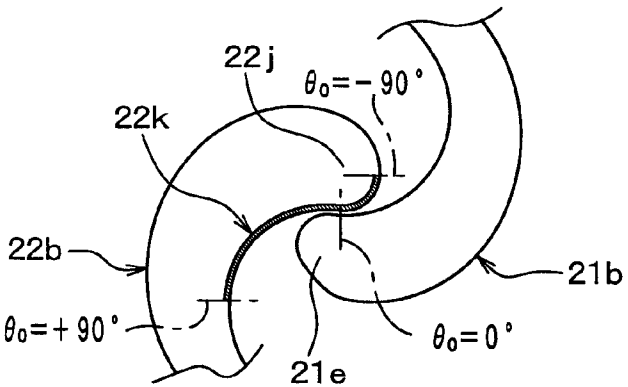
FIG. 3A is a descriptive diagram for describing a wrap clearance of a stationary wrap of a stationary scroll of the variable displacement compressor of the first embodiment.

The amount (depth) of clearance at the wrap clearance 22*k*, which is measured in the direction perpendicular to the inner peripheral wall surface of the stationary wrap 22*b*, is set such that a maximum width (maximum depth) of the wrap clearance 22*k*, which is measured in the direction perpendicular to the inner peripheral wall surface of the stationary wrap 22*b*, is in a range of 0.2 mm to 0.4 mm, as indicated by lines X, Y, Z in FIG. 3B. The wrap clearance extent of the wrap clearance 22*k* (the extent of the wrap clearance 22*k* along the inner peripheral wall surface of the stationary wrap 22*b* in the winding direction of the stationary wrap 22*b*) is an extent, in which the width (amount) of the clearance in the direction perpendicular to the inner peripheral wall surface of the stationary wrap 22*b* is equal to or larger than one half of the maximum width of the wrap clearance 22*k*. For example, in a case where the maximum width (amount) of the wrap clearance is 0.2 mm, the width (amount) of the wrap clearance 22*k* is equal to or larger than 0.1 mm in the extent of the wrap clearance 22*k* along the inner peripheral wall surface of the stationary wrap 22*b*.

Furthermore, in the present embodiment, the stationary wrap 22*b* has an extended portion, which is extended to lengthen a winding terminal end portion (a radially outer end portion) 22*i* of the stationary wrap 22*b* to a winding terminal end portion (radially outer end portion) 21*d* of the orbiting wrap 21*b*, and an inner peripheral wall surface of this extended portion of the stationary wrap 22*b*, which is opposed to an outer peripheral wall surface of the orbiting wrap 21*b*, is a curved surface that is continuous from another portion of the inner peripheral wall surface of the stationary wrap 22*b*, which is other than the extended portion of the stationary wrap 22*b*. Thereby, the compression chamber Va and the compression chamber Vb are asymmetrical to each other to have an asymmetrical winding structure. The winding terminal end portion 22*i* of the stationary wrap 22*b* of the present embodiment is formed by the inner peripheral wall of the outer peripheral portion 22*c* of the stationary scroll 22.

In the case where the wraps 21*b*, 22*b* of the scrolls 21, 22 have the asymmetrical spiral structure, a total volume of the second compression chamber Vb becomes larger than a total volume of the first compression chamber Va, and a maximum total volume of the compression chambers Va, Vb of the compressor 10 (a volume at the time of operating the compressor 10 at the maximum volume, i.e., the maximum displacement) can be increased.

The outer peripheral portion 22*c* of the stationary scroll 22 and the front housing 11 are fixed together by undepicted screws through a sealing member (not shown) in a manner that limits leakage of the refrigerant through the connection between the outer peripheral portion 22*c* of the stationary scroll 22 and the front housing 11. Furthermore, a refrigerant suction inlet 22*d* (FIG. 2) and a suction chamber (also referred to as an intake chamber) 22*e* are formed in the outer peripheral portion 22*c* to draw the refrigerant from the downstream side of the evaporator into the radially outermost portion of the respective compression chambers Va, Vb. The suction chamber 22*e* is formed in the radially outermost portion of the orbiting scroll 21 and is a space, from which the refrigerant is supplied to each compression chamber Va, Vb.

The refrigerant discharge port (the fluid discharge portion) 22*f*, through which the refrigerant is discharged from the radially innermost portion of each of the compression chambers Va, Vb, is formed in a center portion of the stationary base plate 22*a* at a location, which is adjacent to the winding start end portion 22*j* of the stationary wrap 22*b* (see FIG. 2).

The refrigerant discharge port 22*f* forms a refrigerant passage, which communicates between the radially innermost portion of each of the compression chambers Va, Vb and a discharge chamber 12*a* in the inside of the rear housing 12. A discharge valve 12*b*, which is formed as a reed valve, is installed at the discharge chamber 12*a* side of the refrigerant discharge port 22*f* to limit a backflow of the refrigerant (fluid) from the discharge chamber 12*a* to the compression chambers Va, Vb. The discharge valve 12*b* is fixed to the stationary base plate 22*a* with a bolt 12*d* along with a valve stop plate (valve guard) 12*c*, which limits a maximum opening degree of the discharge valve 12*b*.

The rear housing 12 forms the discharge chamber 12*a* and a receiving space, in which the discharge valve 12*b* and the valve stop plate 12*c* are received. Furthermore, a refrigerant discharge outlet (not shown) is formed in the rear housing 12 to discharge the refrigerant from the inside of the discharge chamber 12*a* toward the upstream side of the radiator through the refrigerant discharge outlet.

The rear housing 12 is fixed to an end surface of the stationary base plate 22*a*, which is opposite from the stationary wrap 22*b*, with undepicted screws through a sealing member in a manner that limits leakage of the refrigerant through the connection between the rear housing 12 and the end surface of the stationary base plate 22*a*. In the present embodiment, the orbiting scroll 21 and the stationary scroll 22 are made of an aluminum alloy.

A sub-bypass port (first bypass hole) 22*g*, which is configured as an elongated hole that is elongated in the plane of the stationary base plate 22*a*, is formed in the stationary base plate 22*a* to communicate between the first compression chamber Va and the suction chamber 22*e* through a refrigerant return passage 22*l* during a compression stroke (also referred to as a compression process) of the first compression chamber Va.

The sub-bypass port 22*g* opens in the stationary base plate 22*a* along the adjacent outer peripheral wall surface of the stationary wrap 22*b* at a corresponding location of the stationary base plate 22*a*, which is on the radially outer side of the adjacent outer peripheral wall surface of the stationary wrap 22*b* (see FIG. 2). The second compression chamber Vb is formed as a closed space, which is defined between the inner peripheral wall surface of the stationary wrap 22*b* and the outer peripheral wall surface of the orbiting wrap 21*b*, so that the second compression chamber Vb and the suction chamber 22*e* are not communicated with each other through the sub-bypass port 22*g*, which is formed on the radially outer side of the adjacent outer peripheral wall surface of the stationary wrap 22*b*.

Furthermore, the sub-bypass port 22*g* is sized such that the sub-bypass port 22*g* is closable with a corresponding contact portion of the orbiting wrap 21*b*, which slidably contacts the stationary base plate 22*a*, to disconnect the communication between the first compression chamber Va and the suction chamber 22*e*. That is, the sub-bypass port 22*g* is closed by the corresponding portion of the orbiting wrap 21*b*, which contacts the stationary base plate 22*a*, every time the orbiting scroll 21 revolves. Specifically, a width of the sub-bypass port 22*g*, which is measured in the radial direction of the sub-bypass port 22*g*, is smaller than a width (thickness) of the orbiting wrap 21*b*, which is measured in the radial direction.

Furthermore, a main bypass part (second bypass hole) 22*h*, which is configured into an elongated hole that is elongated in the plane of the stationary base plate 22*a*, is formed in the stationary base plate 22*a* to communicate between the second compression chamber Vb and the suction chamber 22*e* through the refrigerant return passage 22*l* during the compression stroke of the second compression chamber Vb. The main bypass port 22*h* and the sub-bypass port 22*g* are formed as separate independent holes, which are separated from each other.

The main bypass port 22*h* opens in the stationary base plate 22*a* along the adjacent inner peripheral wall surface of the stationary wrap 22*b* at a corresponding location of the stationary base plate 22*a*, which is on the radially inner side of the adjacent inner peripheral wall surface of the stationary wrap 22*b* (see FIG. 2). The first compression chamber Va is formed as a closed space, which is formed by the outer peripheral wall surface of the stationary wrap 22*b* and the inner peripheral wall surface of the orbiting wrap 21*b*, so that the first compression chamber Va and the suction chamber 22*e* are not communicated with each other through the main bypass port 22*h*, which is formed on the radially inner side of the adjacent inner peripheral wall surface of the stationary wrap 22*b*.

Furthermore, the main bypass port 22*h* is sized such that the main bypass port 22*h* is closable with a corresponding contact portion of the orbiting wrap 21*b*, which slidably contacts the stationary base plate 22*a*, to disconnect the communication between the second compression chamber Vb and the suction chamber 22*e*. That is, the main bypass port 22*h* is closed by the corresponding portion of the orbiting wrap 21*b*, which contacts the stationary base plate 22*a*, every time the orbiting scroll 21 revolves. Specifically, a width of the main bypass port 22*h*, which is measured in the radial direction of the main bypass port 22*h*, is smaller than the width (thickness) of the orbiting wrap 21*b*, which is measured in the radial direction.

Figure 4:
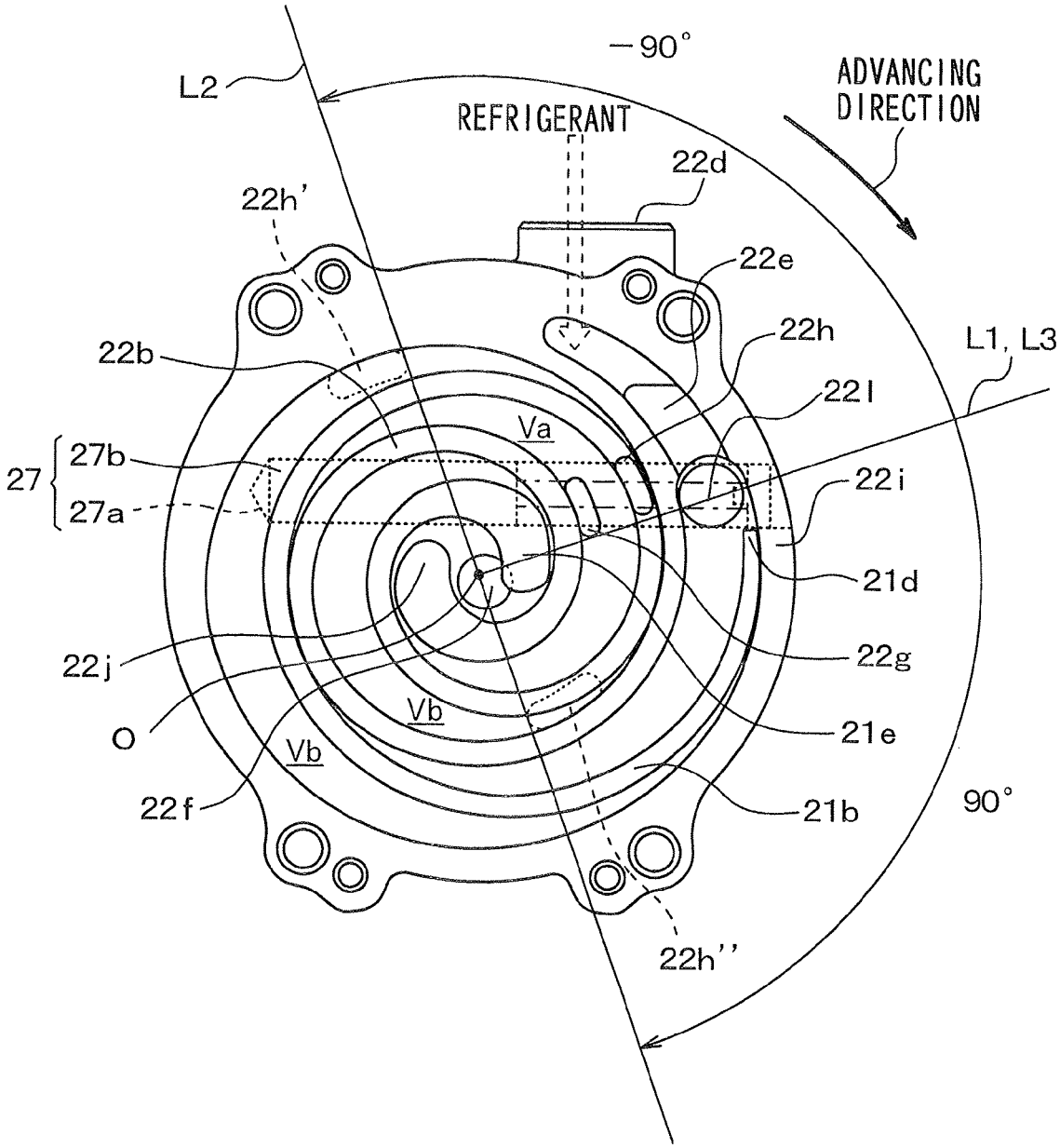
FIG. 4 is a descriptive diagram for describing a position of each of a sub-bypass port and a main bypass port formed in the stationary scroll according to the first embodiment.
Figure 5:
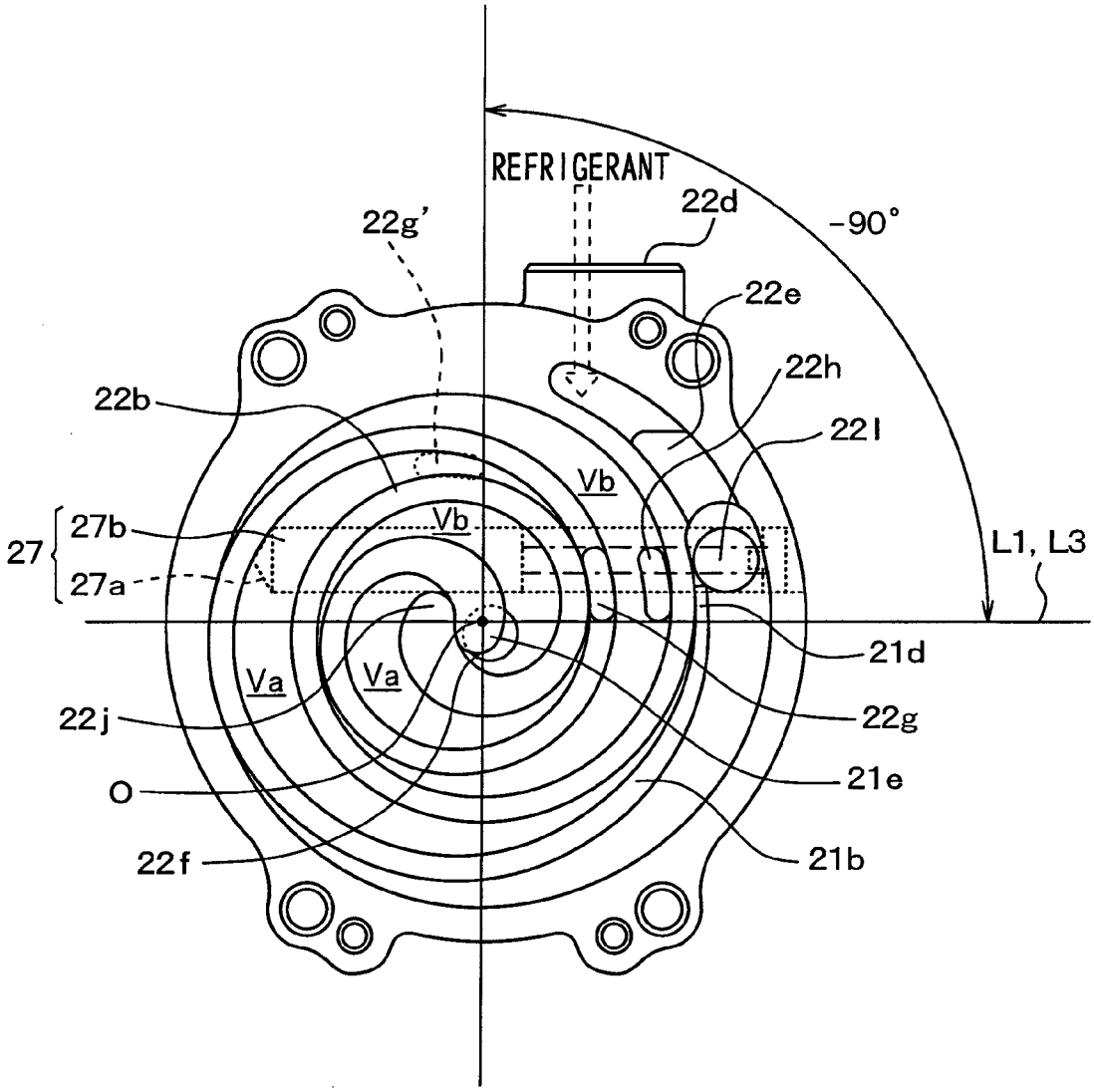
FIG. 5 is a descriptive diagram for describing the position of the sub-bypass port according to the first embodiment.

The arrangement of the sub-bypass port 22*g* and the main bypass port 22*h* will be described with reference to FIGS. 4 and 5. FIG. 4 is a descriptive diagram for describing the position of the sub-bypass port 22*g* and the position of the main bypass port 22*h*. FIG. 5 is a descriptive diagram for describing the position of the sub-bypass port 22*g*. A first imaginary line L1 of FIG. 4 is an imaginary line, which connects between a rotational center (also referred to as an orbiting center or a revolving center) O of the orbiting scroll 21 and the sub-bypass port 22*g*. In other words, the rotational center O of the orbiting scroll 21 and the sub-bypass port 22*g* are located along the first imaginary line L1. A second imaginary line L2 of FIG. 4 is an imaginary line, which extends through the rotational center O of the orbiting scroll 21 and crosses the first imaginary line L1 at a right angle. In other words, the rotational center O of the orbiting scroll 21 is located along the second imaginary line L2, which is perpendicular to the first imaginary line L1 in the plane of the stationary base plate 22*a*. Furthermore, a third imaginary line L3 is an imaginary line, which connects between the rotational center O and the main bypass port 22*h*. In other words, the rotational center O and the main bypass port 22*h* are located along the third imaginary line L3 in the plane of the stationary base plate 22*a*. Furthermore, in this embodiment, as shown in each corresponding drawing, each of the first and third imaginary lines L1, L3 connects between the rotational center O and an advancing end portion (leading end portion) of the corresponding one of the sub-bypass port 22*g* and the main bypass port 22*h*, which is located on an advancing side of the orbiting scroll 21 in the advancing direction of the orbiting scroll 21.

As shown in FIG. 4, the main bypass port 22*h* opens at the corresponding location of the stationary base plate 22*a*, which is on the side of the second imaginary line L2 where the sub-bypass port 22*g* is located in the plane of the stationary base plate 22*a*, so that the timing of communicating between the first compression chamber Va and the suction chamber 22*e* with each other through the sub-bypass port 22*g* is deviated from the timing of communicating between the second compression chamber Vb and the suction chamber 22*e* with each other through the main bypass port 22*h*. In other words, the main bypass port 22*h* is located along the third imaginary line L3 such that an interior angle between the first imaginary line L1 and the third imaginary line L3 is equal to or smaller than 90 degrees. Here, in a case where the angle, which is measured in the advancing direction of the orbiting scroll 21, is defined as a positive angle, the interior angle θ between the first imaginary line L1 and the third imaginary line L3 is in a range of −90 degrees≤θ≤90 degrees. Furthermore, the main bypass port 22*h* should be formed such that at least a portion of the main bypass port 22*h* (the advancing end portion of the main bypass port 22*h* in the advancing direction of the orbiting scroll 21 in this embodiment) opens along the third imaginary line L3.

More specifically, the main bypass port 22*h* of the present embodiment is placed at the location, at which the first imaginary line L1 and the third imaginary line L3 coincide with each other, i.e., at which the interior angle between the first imaginary line L1 and the third imaginary line L3 is zero degrees. Here, it should be understood that the main bypass port 22*h* may be placed at another location, at which the interior angle between the first imaginary line L1 and the third imaginary line L3 is, for instance, 90 degrees, as indicated by numeral 22*h*' or numeral 22*h*" in FIG. 4.

The sub-bypass port 22*g* is formed as follows. Here, the rotational angle (also referred to as an orbital angle or a revolution angle) of the orbiting scroll 21 at the time of discharging the refrigerant from the refrigerant discharge port 22*f* upon merging of the first compression chamber Va and the second compression chamber Vb with each other is defined as the merge reference angle. The sub-bypass port 22*g* is formed at a location, at which the sub-bypass port 22*g* contacts the orbiting wrap 21*b* when the orbiting scroll 21 is advanced to revolve along the stationary base plate 22*a* within a corresponding range that is equal to or larger than −90 degrees and is equal to or smaller than zero (0) degrees relative to the merge reference angle. That is, the sub-bypass port 22*g* is closed with the orbiting scroll 21 when the orbiting scroll 21 is advanced within the corresponding angular range, which is equal to or larger than −90 degrees and is equal to or small than zero (0) degrees, relative to the merge reference angle in the plane of the stationary base plate 22*a*.

More specifically, as shown in FIG. 5, the sub-bypass port 22*g* of the present embodiment is formed at the corresponding location of the stationary base plate 22*a*, at which the sub-bypass port 22*g* contacts the orbiting wrap 21*b* upon the advancing of the orbiting scroll 21 to the merge reference angle along the stationary base plate 22*a*. It should be noted that the sub-bypass port 22*g* may be alternatively formed at another location of the stationary base plate 22*a*, which is indicated by numeral 22*g*' in FIG. 5 and at which the orbiting scroll 21 is advanced by, for instance, −90 degrees (or is retarded by 90 degrees) relative to the merge reference angle.

Furthermore, the compressor 10 of the present embodiment includes an opening and closing device (serving as opening and closing means) 27, which is adapted to open and close each of the sub-bypass port 22*g* and the main bypass port 22*h*. The opening and closing device (opening and closing means) 27 functions as a discharge volume changing device (discharge volume changing means), which changes, i.e., varies the discharge volume (displacement) of the compressor 10 by opening or closing each of the sub-bypass port 22*g* and the main bypass port 22*h*.

The opening and closing device 27 includes a cylinder bore (cylindrical hole) 27*a*, a spool valve element 27*b* and a pressure adjusting device (serving as pressure adjusting means) 28. The cylinder bore 27*a* is formed in the stationary base plate 22*a*. The spool valve element 27*b* is slidably received in the cylinder bore 27*a*. The pressure adjusting device (pressure adjusting means) 28 adjusts the pressure, which is applied to the spool valve element 27*b*.

The cylinder bore 27*a* is formed in the inside of the stationary base plate 22*a* and extends linearly in a direction that is perpendicular to the rotational axis α. The spool valve element 27*b* has an outer diameter, which is generally the same as an inner diameter of the cylinder bore 27*a*. The spool valve element 27*b* slides in the cylinder bore 27*a* to open or close each of the sub-bypass port 22*g* and the main bypass port 22*h*.

A coil spring (not shown) is placed on one end side of the spool valve element 27*b* in the sliding direction of the spool valve element 27*b* to exert a resilient force, which urges the spool valve element 27*b* toward the other end side of the spool valve element 27*b*. A suction pressure Ps of the suction chamber 22*e* is exerted at the one end side of the spool valve element 27*b* in addition to the resilient force of the coil spring.

A control pressure chamber 30 is formed at the other end side of the spool valve element 27*b* and is communicated with the discharge chamber 12*a* through a fixed choke 29, which has a fixed passage diameter. A control pressure Pc, which is adjusted by the pressure adjusting device (pressure adjusting means) 28, is applied to the control pressure chamber 30.

The pressure adjusting device (pressure adjusting means) 28 includes a control passage 28*a* and a solenoid valve 28*b*. The control passage 28*a* communicates between the suction chamber 22*e* and the control pressure chamber 30. The solenoid valve 28*b* opens or closes the control passage 28*a*. The solenoid valve 28*b* of the present embodiment is a normally open type.

Figure 6B:
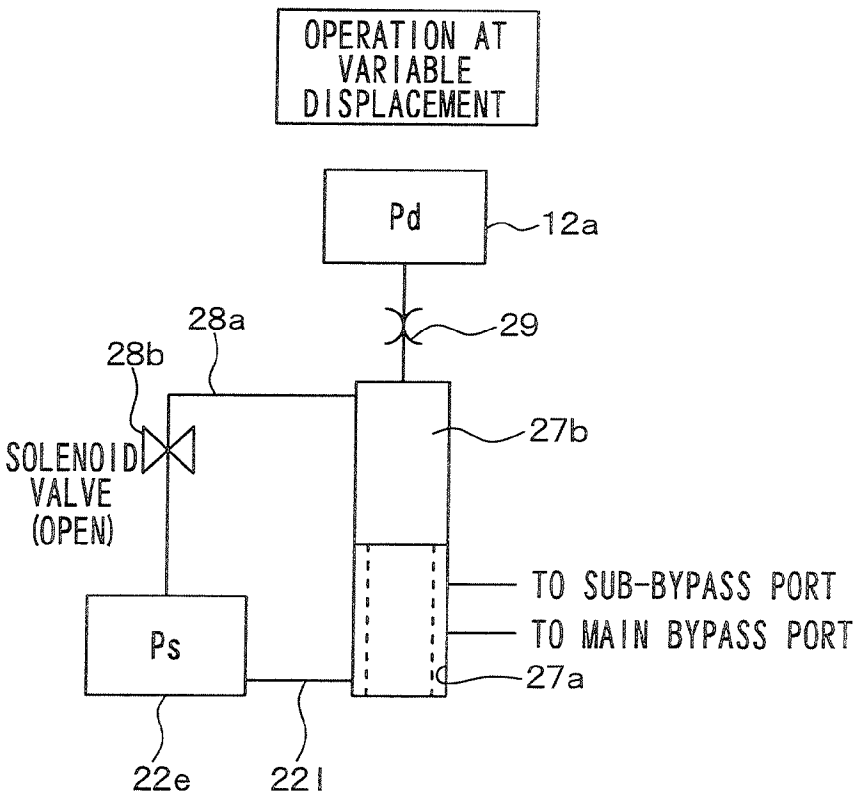
FIG. 6B is a schematic diagram showing an operation of the compressor at a variable displacement operational mode, indicating an open state of the solenoid valve according to the first embodiment.
Figure 6A:
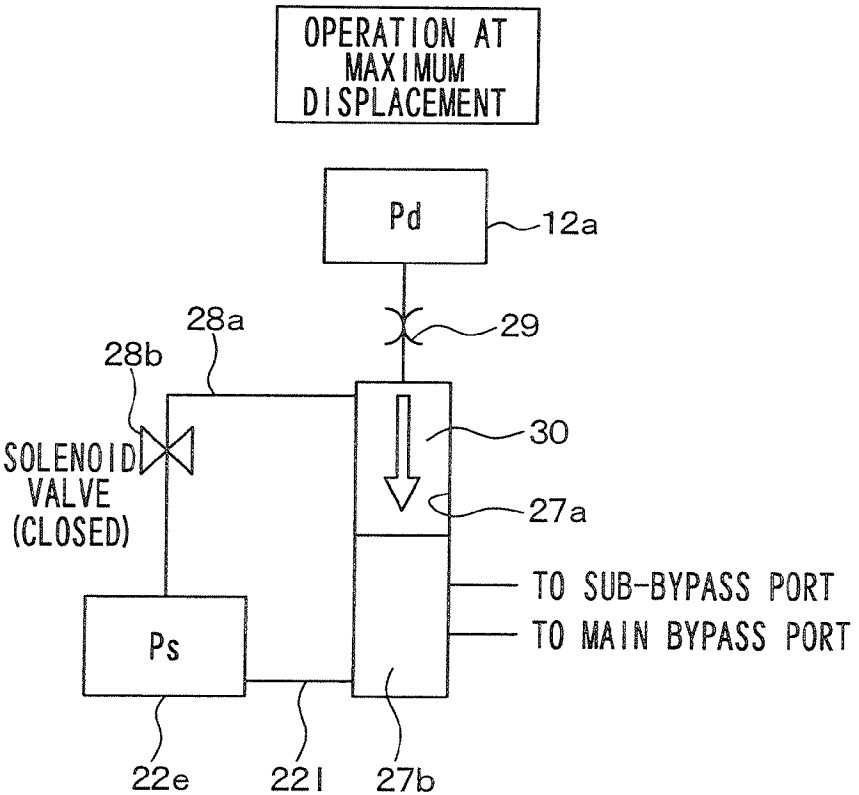
FIG. 6A is a schematic diagram showing an operation of the compressor at a maximum displacement operational mode, indicating a closed state of a solenoid valve according to the first embodiment.

Now, the operation of the opening and closing device 27 will be described with reference to FIGS. 6A and 6B. FIG. 6A is a schematic diagram showing an operation of the compressor 10 at a maximum displacement (100%), i.e., at a maximum displacement operational mode. FIG. 6B is a schematic diagram showing an operation of the compressor 10 at a variable displacement, i.e., a variable displacement operational mode.

At the operation of the compressor 10 at the maximum displacement operational mode (100%), as shown in FIG. 6A, the solenoid valve 28*b* is closed, so that the control passage 28*a* is closed, and the refrigerant, which is supplied from the discharge chamber 12*a*, flows into the control pressure chamber 30 upon depressurization thereof through the fixed choke 29. Thereby, the pressure (control pressure) Pc of the control pressure chamber 30 is increased to a predetermined discharge pressure Pd. In this way, the spool valve element 27*b* is moved toward the one end side in the sliding direction, so that the communication between the sub-bypass and main bypass ports 22*g*, 22*h* and the suction chamber 22*e* is disconnected.

In contrast, at the time of operating the compressor 10 at the variable displacement operational mode, as shown in FIG. 6B, the solenoid valve 28*b* is opened, so that the refrigerant, which is supplied from the discharge chamber 12*a*, flows into the suction chamber 22*e* through the control pressure chamber 30 upon depressurization thereof through the fixed choke 29. At this time, the refrigerant of the discharge chamber 12*a* is sufficiently depressurized through the fixed choke 29 and is then supplied into the control pressure chamber 30. Therefore, when the solenoid valve 28*b* is opened, the pressure supplied from the suction chamber 22*e* has a greater influence on the pressure of the control pressure chamber 30 in comparison to the pressure supplied from the discharge chamber 12*a*. Therefore, when the solenoid valve 28*b* is opened, the pressure (control pressure) Pc of the control pressure chamber 30 is decreased to a pressure that is equal to or around the suction pressure Ps. In this way, the spool valve element 27*b* is moved toward the other end side in the sliding direction, so that the sub-bypass and main bypass ports 22*g*, 22*h* are communicated with the suction chamber 22*e*.

Figure 7A:
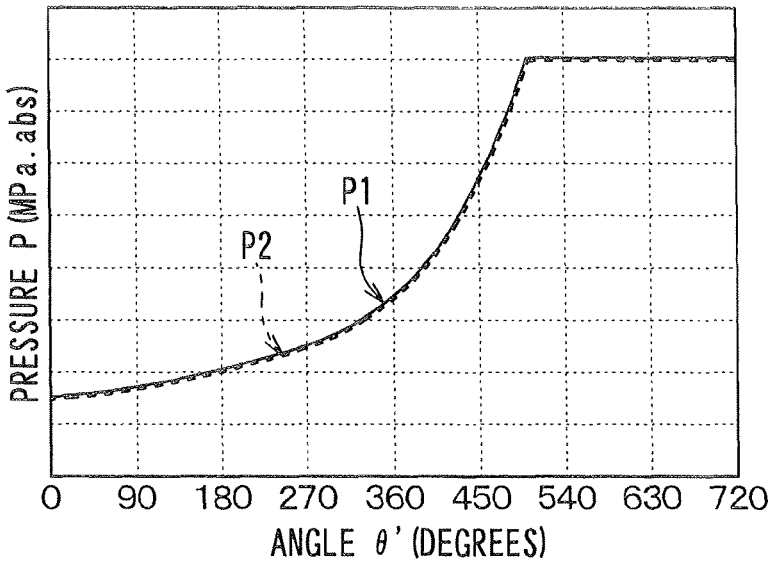
FIG. 7A is a descriptive diagram for describing a relationship between a rotational angle of the orbiting scroll and a pressure of each compression chamber during the operation of the compressor at the maximum displacement operational mode according to the first embodiment.
Figure 7B:
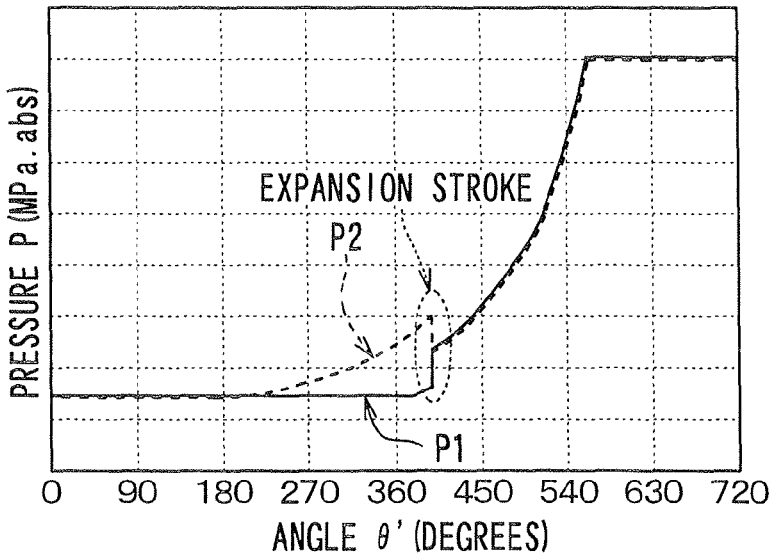
FIG. 7B is a descriptive diagram for describing a relationship between a rotational angle of the orbiting scroll and a pressure of each compression chamber during the operation of the compressor at the variable displacement operational mode according to the first embodiment.
Figure 7C:
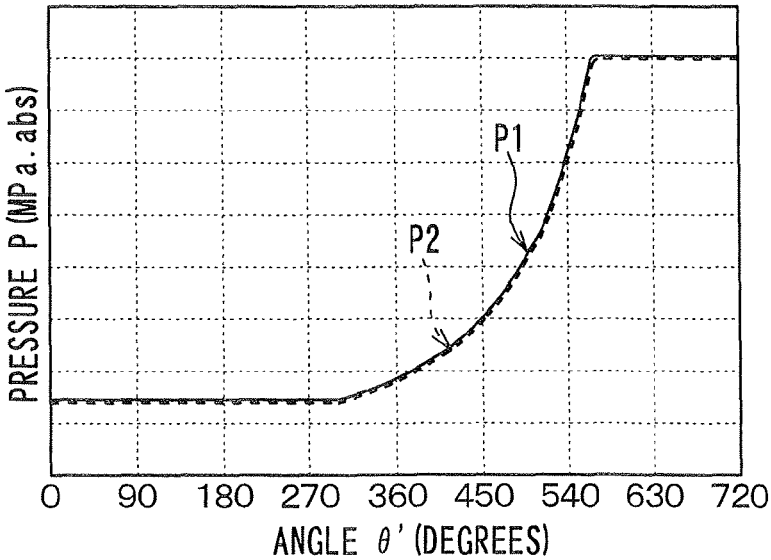
FIG. 7C PRIOR ART
FIG. 7C is a descriptive diagram for describing a relationship between a rotational angle of an orbiting scroll and a pressure of each compression chamber of a prior art variable displacement scroll compressor at the time of operating the compressor at the variable displacement operational mode.

Next, the operation of the compressor 10 will be described with reference to FIGS. 7A to 12. FIG. 7A to 7C are descriptive diagrams (a pressure to angle diagram, which will be hereinafter denoted as a P-θ diagram) for describing a relationship between the rotational angle θ of the orbiting scroll 21 and the pressure P1, P2 of each compression chamber Va, Vb. Specifically, FIG. 7A is a P-θ diagram at the time of operating the compressor 10 at the maximum capacity operational mode. FIG. 7B is a P-θ diagram at the time of operating the compressor 10 at the variable displacement operational mode. FIG. 7C is a P-θ diagram at the time of operating the prior art compressor, in which the two bypass ports are symmetrically placed about the rotational center (also referred to as an orbital center or a revolution center) of the orbiting scroll 21, at the variable displacement operational mode. In FIGS. 7A to 7C, for descriptive purpose, it is assumed that the rotational angle θ' at the time of completing the intake stroke of the first compression chamber Va during the operation of the compressor at the maximum displacement operational mode is zero (0) degrees.

When the drive force of the drive engine is transmitted to the shaft 14 of the compressor 10 through the drive force conducting device (the drive force conducting means), such as the V-belt, the pulley or the electromagnetic clutch, the shaft 14 is rotated. In response to the rotation of the shaft 14, the orbiting scroll 21, which is connected to the crankshaft 15, revolves about the rotational axis α. At this time, due to the action of the rotation limiting mechanism (the rotation limiting pins 23, 24 and the ring member 25), the orbiting scroll 21 orbits, i.e., revolves about the rotational axis a without making rotation (self-rotation) about the center axis 13 of the crankshaft 15.

Because of this revolution of the orbiting scroll 21, each of the compression chambers Va, Vb, which are defined between the orbiting wrap 21*b* and the stationary wrap 22*b*, is displaced, i.e., is moved from the radially outer side to the radially inner side while reducing a volume of the compression chamber Va, Vb. Thereby, the refrigerant, which is drawn from the suction chamber 22*e* into the radially outermost portion of the compression chamber Va, Vb, is progressively compressed and thereby becomes the high pressure upon being displaced from the radially outer side to the radially inner side. Then, this high pressure refrigerant is discharged from the radially innermost portion of the compression chamber Va, Vb into the discharge chamber 12*a* through the refrigerant discharge port 22*f*.

In this way, the compressor 10 of the present embodiment functions as the refrigerant compressor of the vehicle air conditioning system, so that the refrigerant is drawn from the downstream side of the evaporator into the compressor 10 through the refrigerant suction inlet 22*d* and is thereafter discharged from the compressor 10 to the upstream side of the radiator through the refrigerant discharge outlet (not shown) of the compressor 10 upon compressing the refrigerant to the high pressure.

Now, the operation of the compressor 10 at the maximum displacement operational mode (100% displacement) will be described. At the time of operating the compressor 10 at the maximum displacement operational mode, the solenoid valve 28*b* is energized to close the solenoid valve 28*b*, so that each of the sub-bypass port 22*g* and the main bypass port 22*h* is closed with the spool valve element 27*b* to operate the compressor 10 at the maximum displacement operational mode. In this state, the refrigerant is drawn from the suction chamber 22*e* into the radially outermost portion of each of the compression chambers Va, Vb and is discharged from the compression chamber Va, Vb into the discharge chamber 12*a* through the refrigerant discharge port 22*f* upon being compressed in the compression chamber Va, Vb.

A relationship between the pressures P1, P2 of the first and second compression chambers Va, Vb and the rotational angle of the orbiting scroll 21 at this maximum displacement becomes the relationship shown in FIG. 7A. Specifically, at each of the first and second compression chambers Va, Vb, the compression stroke starts when the rotational angle θ' of the orbiting scroll 21 is advanced to zero degrees or therearound. Then, when the rotational angle of the orbiting scroll 21 is increased, the pressure of each of the first and second compression chambers Va, Vb is increased, as shown in FIG. 7A.

Figure 8:
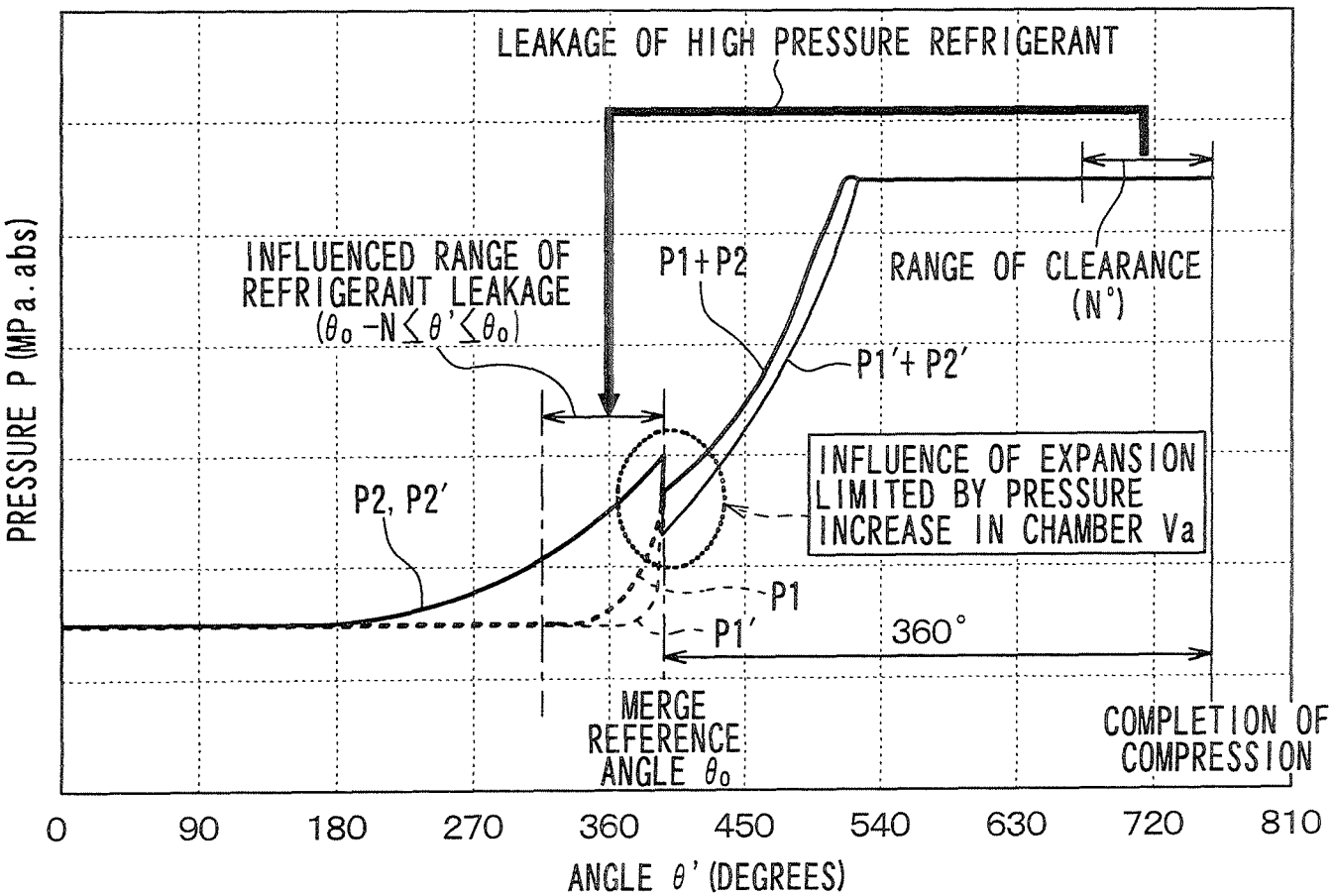
FIG. 8 is a descriptive diagram for describing a relationship between pressures of first and second compression chambers and a rotational angle of the orbiting scroll according to the first embodiment.
Figure 9A:
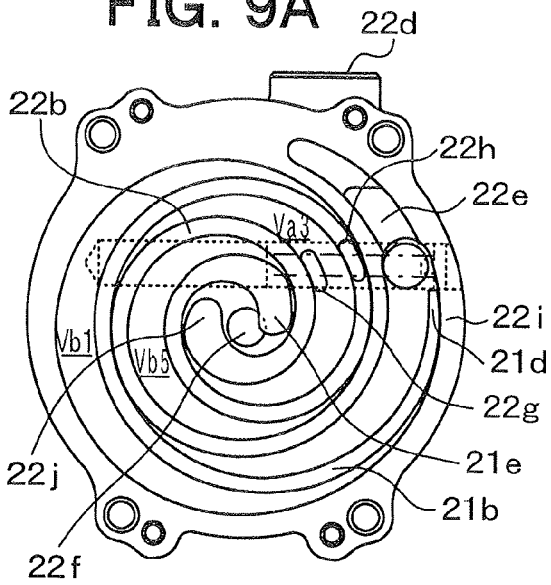
FIGS. 9A to 9D are descriptive diagrams for describing the operation of the compressor at the variable displacement operational mode according to the first embodiment.
Figure 9B:
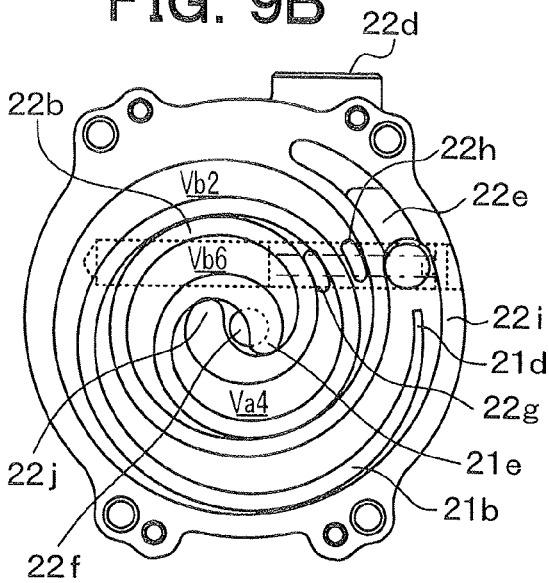
Figure 9D:
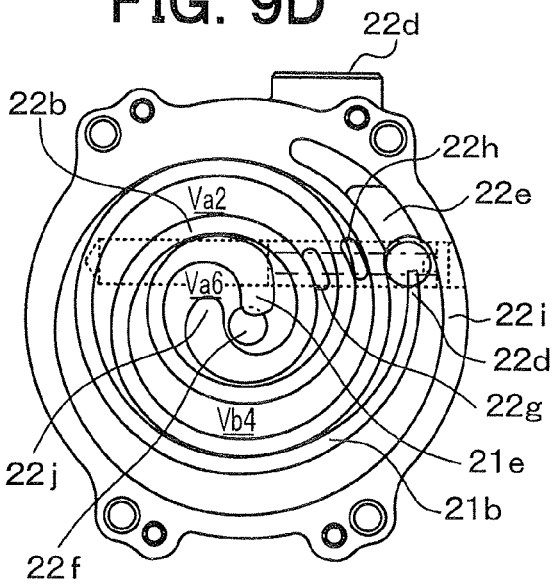
Figure 9C:
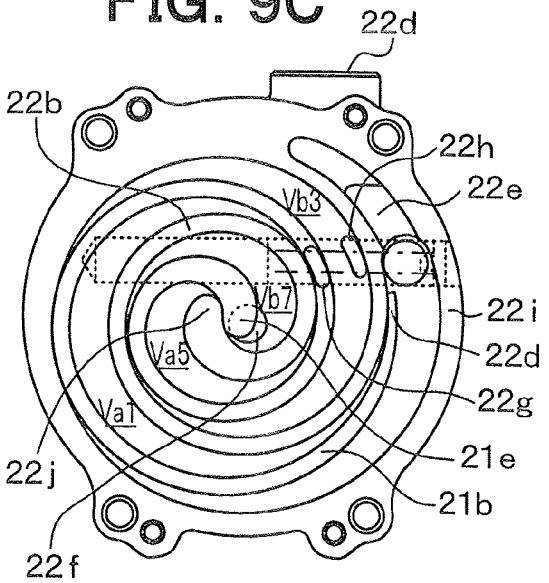

Next, an operation of the compressor 10 at the variable displacement operational mode will be described with reference to FIGS. 8 to 9C. FIG. 8 is a descriptive diagram for describing a relationship between the pressures P1, P2 of the first and second compression chambers Va, Vb and the rotational angle of the orbiting scroll 21. FIGS. 9A to 9C are descriptive diagrams for describing the operation of the compressor 10 of the present embodiment at the variable displacement operational mode. Specifically, FIG. 9A indicates an operational state of the compressor 10 at the variable displacement operational mode when the suction stroke of the second compression chamber Vb is completed, that is, when the rotational angle θ of the orbiting scroll 21 is zero (0) degrees, i.e., 0=zero degrees (or θ=360 degrees). FIG. 9B indicates an operational state of the compressor 10 at the variable displacement operational mode when the rotational angle θ of the orbiting scroll 21 is 90 degrees, i.e., θ=90 degrees (or θ=450 degrees). FIG. 9C indicates an operational state of the compressor 10 at the variable displacement operational mode when the rotational angle θ of the orbiting scroll 21 is 180 degrees, i.e., θ=180 degrees (or θ=540 degrees). FIG. 9D indicates an operational state of the compressor 10 at the variable displacement operational mode when the rotational angle θ of the orbiting scroll 21 is 270 degrees, i.e., θ=270 degrees (or θ=630 degrees). In FIGS. 9A to 9D, it is assumed that the rotational angle of the orbiting scroll 21 at the time of completing the suction stroke in the second compression chamber Vb is zero degrees.

At the time of operating the compressor 10 at the variable displacement operational mode, the energization of the solenoid valve 28*b* is stopped to open the solenoid valve 28*b*, so that each of the sub-bypass port 22*g* and the main bypass port 22*h* is opened, and thereby the compressor 10 is operated at the variable displacement operational mode. In this state, the refrigerant is drawn from the suction chamber 22*e* into the radially outermost portion of each of the first and second compression chambers Va, Vb and is discharged from the compression chamber Va, Vb into the discharge chamber 12*a* through the refrigerant discharge port 22*f* upon being compressed in the compression chamber Va, Vb.

Now, the operation of the compressor 10 at the variable displacement operational mode will be described with reference to the relationship between the first and second compression chambers Va, Vb and the sub-bypass and main bypass ports 22*g*, 22*h*.

First of all, in the second compression chamber Vb, the suction stroke of the refrigerant is completed at the volume Vb1 of FIG. 9A (the rotational angle θ=zero degrees). In this state, the main bypass port 22*h* is closed by the corresponding contact portion of the orbiting wrap 21*b*, which slidably contacts the stationary base plate 22*a*. Therefore, the refrigerant of the second compression chamber Vb does not flow into the suction chamber 22*e* through the main bypass port 22*h*.

Thereafter, at the transition period from the volume Vb1 of FIG. 9A to the volume Vb2 of FIG. 9B (i.e., the volume at the rotational angle θ=90 degrees), the main bypass port 22*h* is opened, so that the refrigerant of the second compression chamber Vb flows into the suction chamber 22*e* through the main bypass port 22*h*. Specifically, the compressor 10 is placed into the state where the refrigerant cannot be compressed in the second compression chamber Vb (more specifically, the second compression chamber Vb having the volume Vb2 of FIG. 9B).

Then, in this communicated state where the second compression chamber Vb is communicated with the suction chamber 22*e*, the volume of the second compression chamber Vb is reduced from the volume Vb3 of FIG. 9C (i.e., the volume at the rotational angle θ=180 degrees), to a volume Vb4 of FIG. 9D (i.e., the volume at the rotational angle θ=270 degrees). Specifically, after the state shown in FIG. 9A (i.e., the state where the suction stroke of the second compression chamber Vb is completed), the refrigerant in the second compression chamber Vb flows into the suction chamber 22*e* through the main bypass port 22*h*, and thereby the refrigerant is not compressed in the second compression chamber Vb.

Next, when the volume of the second compression chamber Vb is changed to a volume Vb5 shown in FIG. 9A, the communication between the main bypass port 22*h* and the suction chamber 22*e* is disconnected, and thereby the refrigerant of the second compression chamber Vb is compressed (start of compression of the refrigerant). Then, the volume of the second compression chamber Vb is reduced from the volume Vb5 shown in FIG. 9A to a volume Vb6 shown in FIG. 9B.

Thereafter, when the volume of the second compression chamber Vb is reduced to a volume Vb7 shown in FIG. 9C, the second compression chamber Vb is communicated with the refrigerant discharge port 22*f*. At this time, the refrigerant of the second compression chamber Vb reaches the predetermined discharge pressure upon the reduction of the volume of the second compression chamber Vb, and the refrigerant of the second compression chamber Vb is discharged into the discharge chamber 12*a* through the refrigerant discharge port 22*f*.

In contrast, in the first compression chamber Va, the suction stroke of the refrigerant is completed at a volume Va1 of FIG. 9C (the rotational angle θ=180 degrees). In this state, the sub-bypass port 22*g* is closed by the corresponding contact portion of the orbiting wrap 21*b*, which slidably contacts the stationary base plate 22*a*. Therefore, the refrigerant of the first compression chamber Va does not flow into the suction chamber 22*e* through the sub-bypass port 22*g*.

Thereafter, at the transition period from the volume Va1 of FIG. 9C to the volume Va2 of FIG. 9D (i.e., the volume at the rotational angle θ=270 degrees), the sub-bypass port 22*g* is opened, so that the refrigerant of the first compression chamber Va flows into the suction chamber 22*e* through the sub-bypass port 22*g*. Specifically, the compressor 10 is placed into the state where the refrigerant cannot be compressed in the first compression chamber Va (more specifically, the first compression chamber Va having the volume Va2 of FIG. 9D).

Then, in this communicated state where the first compression chamber Va is communicated with the suction chamber 22*e*, the volume of the first compression chamber Va is reduced from the volume Va3 of FIG. 9A (i.e., the volume at the rotational angle θ=zero degrees), to a volume Va4 of FIG. 9B (i.e., the volume at the rotational angle θ=90 degrees). Specifically, after the state shown in FIG. 9C (i.e., the state where the suction stroke of the first compression chamber Va is completed), the refrigerant in the first compression chamber Va flows into the suction chamber 22*e* through the sub-bypass port 22*g*, and thereby the refrigerant is not compressed in the first compression chamber Va.

Thereafter, at a transition period from a volume Va5 of FIG. 9C to a volume Va6 of FIG. 9D, the communication between the sub-bypass port 22*g* and the suction chamber 22*e* is disconnected, and thereby the refrigerant of the first compression chamber Va is compressed (start of compression of the refrigerant). Thereafter, when the volume of the first compression chamber Va is reduced to the volume Va6 of FIG. 9D, the first compression chamber Va is communicated with the refrigerant discharge port 22*f*. At this time, the refrigerant of the first compression chamber Va reaches the predetermined discharge pressure upon the reduction of the volume of the first compression chamber Va, and the refrigerant of the first compression chamber Va is discharged into the discharge chamber 12*a* through the refrigerant discharge port 22*f*. The compression stroke is completed at a corresponding position, which is after the revolution of the orbiting scroll 21 through 360 degrees in the advancing direction from the merge reference angle, at which the first compression chamber Va and the second compression chamber Vb are communicated with each other.

In the case of the prior art compressor, in which the two bypass ports are symmetrically placed about the rotational center O, the relationship between the pressures P1, P2 of the first and second compression chambers Va, Vb of the prior art compressor and the rotational angle θ' of the orbiting scroll 21 at the time of operating the prior art compressor at the variable displacement operational mode becomes the relationship shown in FIG. 7C. Specifically, as shown in FIG. 7C, at each of the first and second compression chambers Va, Vb, the compression stroke starts when the rotational angle θ' of the orbiting scroll 21 is advanced to 270 degrees or therearound. Then, when the rotational angle of the orbiting scroll 21 is increased, the pressure of each of the first and second compression chambers Va, Vb is increased.

In contrast to this, the relationship between the pressures P1, P2 of the first and second compression chambers Va, Vb of the compressor 10 of the present embodiment and the rotational angle θ' of the orbiting scroll 21 at the time of operating the compressor 10 of the present embodiment at the variable displacement operational mode becomes the relationship shown in FIG. 7B. Specifically, as shown in FIG. 7B, in the second compression chamber Vb, the compression stroke starts when the orbiting scroll 21 is advanced to the rotational angle θ' of 180 degrees or therearound. Then, when the rotational angle of the orbiting scroll 21 is increased, the pressure of the second compression chamber Vb is increased. In contrast, in the first chamber Va, the compression stroke starts when the orbiting scroll 21 is advanced to the rotational angle θ' of 360 degrees or therearound. Then, when the rotational angle of the orbiting scroll 21 is further increased, the pressure of the first compression chamber Va is increased. Thereafter, when the rotational angle θ' of the orbiting scroll 21 is advanced to 400 degrees or therearound, the first compression chamber Va and the second compression chamber Vb are communicated with each other to merge the refrigerant of the first compression chamber Va and the refrigerant of the second compression chamber Vb together, so that the pressure of the first compression chamber Va and the pressure of the second compression chamber Vb become equal to each other. Thereafter, the compression of the refrigerant in each of the first compression chamber Va and the second compression chamber Vb proceeds further.

As described above, in the compressor 10 of the present embodiment, when the rotational angle θ' of the orbiting scroll 21 is advanced to 180 degrees or therearound, the compression stroke starts at the one (specifically, the second compression chamber Vb) of the two compression chambers Va, Vb. Therefore, in comparison to the prior art compressor, the total compression stroke (the total compression process or the total compression period) of the compressor 10 can be prolonged, i.e., lengthened at the time of operating the compressor 10 of the present embodiment at the variable displacement operational mode.

The P-θ diagram of FIG. 7B indicates that when the rotational angle θ' of the orbiting scroll 21 is advanced to 400 degrees or therearound, the first compression chamber Va and the second compression chamber vb are communicated with each other to have an expansion stroke caused by an increase in the volume of the merged compression chamber. However, in reality, the occurrence of the expansion stroke is limited as indicated by the P-θ diagram of FIG. 8. In FIG. 8, the actual P-θ diagram is indicated by a solid bold line (P2) and a solid bold line (P1), and the P-θ diagram of FIG. 7B is indicated by a solid thin line (P2') and a solid thin line (P1').

The limiting of the occurrence of the expansion stroke is implemented with the following principle. That is, in the stationary wrap 22*b* of the present embodiment, the wrap clearance 22*k* is formed in the winding start end portion 22*j*. Therefore, in a period of the angular range N of the wrap clearance 22*k*, which extends from the point of the completion of the compression stroke, the high pressure refrigerant, which is present in the second compression chamber Vb, leaks into the first compression chamber Va (the first compression chamber Va being a compression chamber that discharges the refrigerant next time), which is retarded by 360 degrees, through the wrap clearance 22*k*.

In this way, the pressure of the refrigerant of the first compression chamber Va is increased to reduce a pressure difference between first compression chamber Va and the second compression chamber Vb. Therefore, at the time of communicating the first compression chamber Va and the second compression chamber Vb to merge the refrigerant of the first compression chamber Va and the refrigerant of the second compression chamber Vb together, the occurrence of the expansion stroke is limited or minimized.

Here, the influenced range, in which the pressure of the refrigerant of the first compression chamber Va is increased by the high pressure refrigerant leaked through the wrap clearance 22*k*, is the range ($\theta o - N \leq \theta' \leq \theta o$), which is retarded by the range N (degrees) of the wrap clearance 22*k* from the merge reference angle θo.

Therefore, the timing of starting the compression of the first compression chamber Va is set to be in the influenced range, in which the high pressure refrigerant is leaked into the first compression chamber Va through the wrap clearance 22*k*. In other words, the sub-bypass port 22*g* is closed in the influenced range, in which the high pressure refrigerant is leaked into the first compression chamber Va through the wrap clearance 22*k*. In this way, the pressure of the refrigerant in the first compression chamber Va can be increased by the high pressure refrigerant supplied to the first compression chamber Va through the wrap clearance 22*k*. Meanwhile, in the second compression chamber Vb, the influence of the leakage of the refrigerant through the wrap clearance 22*k* can be reduced or minimized.

The sub-bypass port 22*g* of the present embodiment is constructed to be closed at the advanced angle of the orbiting scroll 21, which is advanced from the merge reference angle. Thereby, the pressure of the refrigerant of the first compression chamber Va can be increased by the high pressure refrigerant that is supplied to the first compression chamber Va through the wrap clearance 22*k*.

With the above described construction of the present embodiment, at the time of operating the compressor 10 at the variable displacement operational mode, the timing of communicating the first compression chamber Va to the suction chamber 22*e* is shifted, i.e., is deviated from the timing of communicating the second compression chamber Vb to the suction chamber 22*e*. Therefore, the volumes of the first and second compression chambers Va, Vb at the time of starting the compression are different from each other. As a result, in comparison to the prior art compressor, in which the bypass ports 22*g*, 22*h* are symmetrically placed about the rotational center O of the orbiting scroll 21, it is possible to lengthen the total compression stroke (the total compression process or the total compression period) of the compressor 10 at the time of operating the compressor 10 at the variable displacement operational mode.

Particularly, in the present embodiment, the main bypass port 22*h* is placed adjacent to the sub-bypass port 22*g*. More specifically, the sub-bypass port 22*g* and the main bypass port 22*h* are located between a predetermined part of the inner peripheral wall surface of the stationary wrap 22*b* and a predetermined part of the outer peripheral wall surface of the stationary wrap 22*b*, which are adjacent to each other and are directly radially opposed to each other in the stationary wrap 22*b* in a direction that is generally parallel to the first imaginary line L1 and the third imaginary line L3 shown in, for example, FIG. 5. Because of the adjacent placement of the sub-bypass port 22*g* and the main bypass port 22*h*, it is possible to increase the difference between the volume of the one of the two compression chambers Va, Vb and the volume of the other one of the two compression chambers Va, Vb at the time of operating the compressor at the variable displacement operational mode. In this way, it is possible to sufficiently lengthen the total compression stroke (the total compression process or the total compression period) of the compressor 10 at the time of operating the compressor 10 at the variable displacement operational mode.

Therefore, at the time of operating the compressor 10 at the variable displacement operational mode, the compression of the fluid (the refrigerant in this embodiment) becomes moderate (slower), so that it is possible to limit the leakage of the refrigerant from each of the compression chambers Va, Vb. Thus, it is possible to limit the reduction of the compression efficiency at the time of operating the compressor at the variable displacement operational mode.

Figure 10:
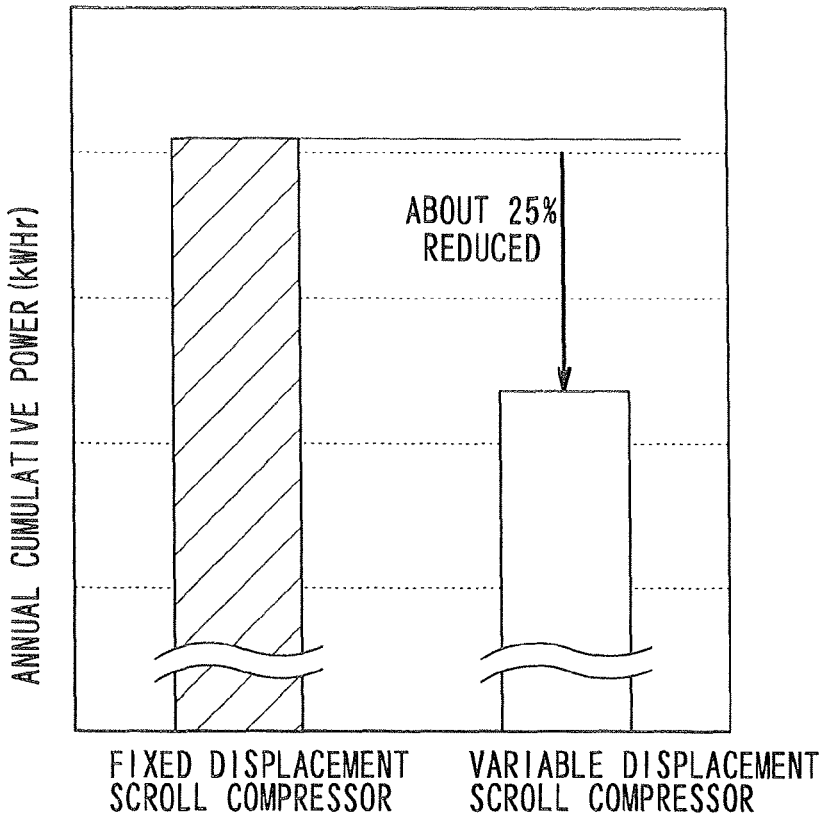
FIG. 10 is a descriptive diagram for describing an annual cumulative power of a variable displacement scroll compressor and an annual cumulative power of a fixed displacement scroll compressor.

Here, in the case of the variable displacement scroll compressor, as shown in FIG. 10, the annual cumulative power, which the amount electric power required to drive the compressor per year, can be reduced by about 25% in comparison to the fixed displacement scroll compressor upon assumption of that there is no deterioration in the efficiency at the time of operation of the compressor at the variable displacement operational mode. FIG. 10 is a descriptive diagram for describing the annual cumulative power of the variable displacement scroll compressor and the annual cumulative power of the fixed displacement scroll compressor and indicating a simulation result obtained under the common condition, in which a cooling capacity of the vehicle air conditioning system is kept the same for the variable displacement scroll compressor and the fixed displacement scroll compressor.

Figure 11:
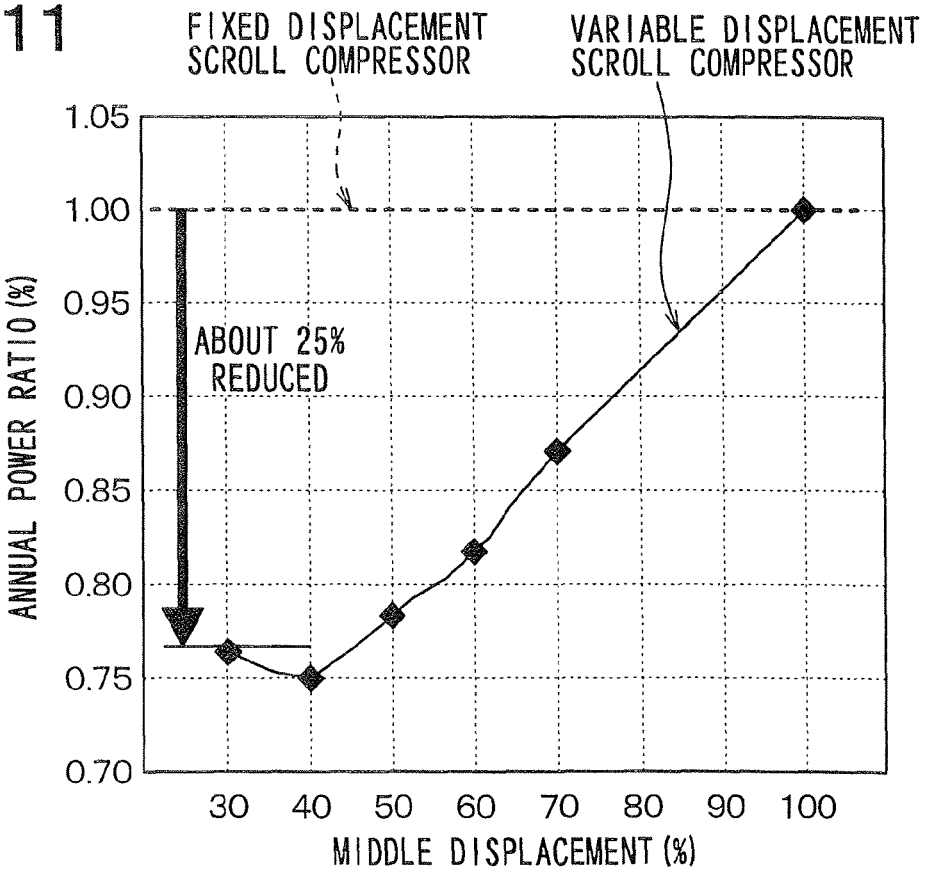
FIG. 11 is a descriptive diagram for describing a relationship between a power ratio of the annual cumulative power of the variable displacement scroll compressor relative to the annual cumulative power of the fixed displacement scroll compressor and a middle displacement of the variable displacement scroll compressor.

Furthermore, as shown in FIG. 11, an annual power ratio (%), which is a ratio of the annual cumulative power of the variable displacement scroll compressor relative to the annual cumulative power of the fixed displacement scroll compressor, is reduced when a middle displacement (also referred to as an intermediate displacement) of the variable displacement scroll compressor, which is a displacement of the compressor at the time of operating the compressor at the variable displacement operational mode, is reduced, thereby increasing the power consumption reducing effect of the variable displacement scroll compressor. FIG. 11 is a descriptive diagram for describing a relationship between the power ratio of the annual cumulative power of the variable displacement scroll compressor relative to the annual cumulative power of the fixed displacement scroll compressor and the middle displacement of the variable displacement scroll compressor.

However, there is a possible drawback of deteriorating a compression efficiency of the variable displacement scroll compressor in a case where the middle capacity of the variable displacement scroll compressor becomes too small (e.g., equal to or less than 40%), which possibly results in the reduction in the total compression stroke.

Figure 12:
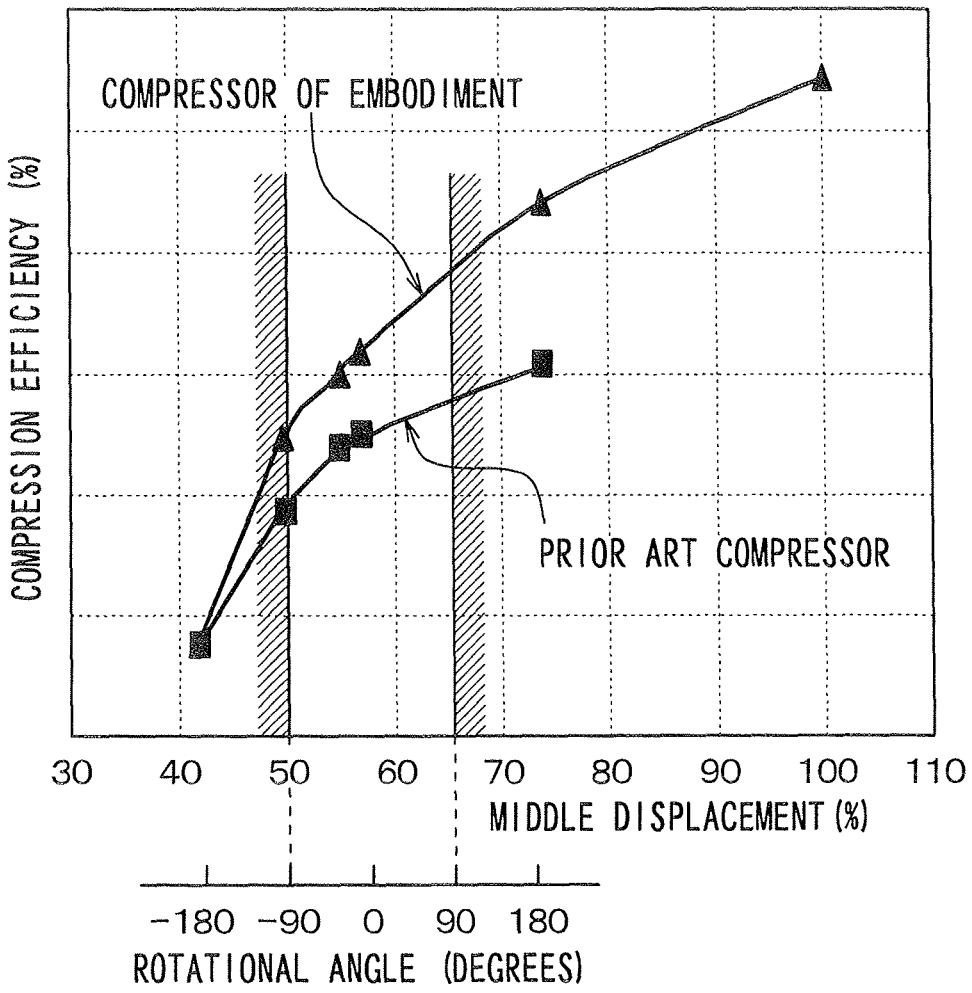
FIG. 12 is a descriptive diagram for describing a relationship between the middle displacement and compression efficiency of the variable displacement scroll compressor of the first embodiment in comparison to that of the prior art compressor.
Figure 13A:
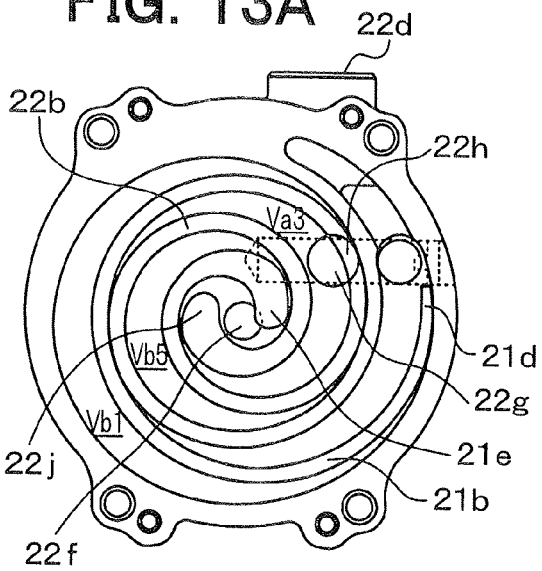
FIGS. 13A to 13D are descriptive diagrams for describing an operation of a variable displacement scroll compressor according to a second embodiment of the present invention.
Figure 13B:
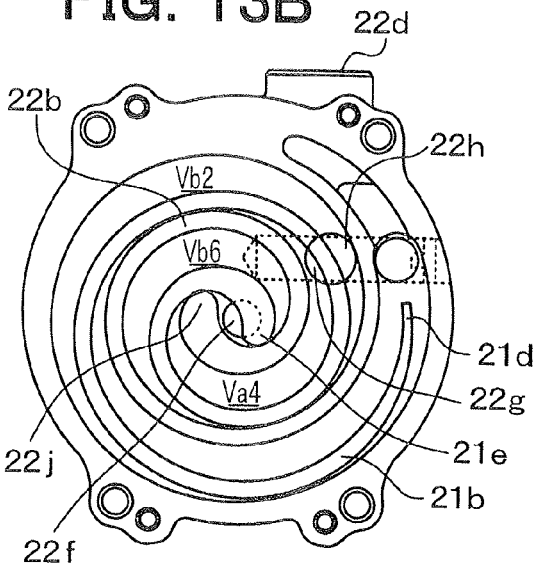
Figure 13D:
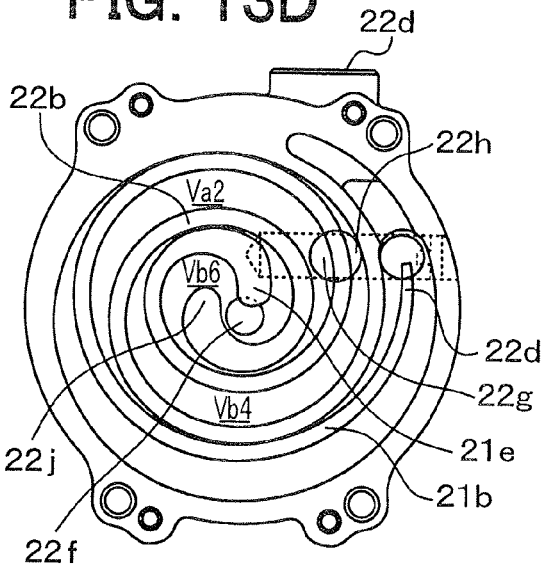
Figure 13C:
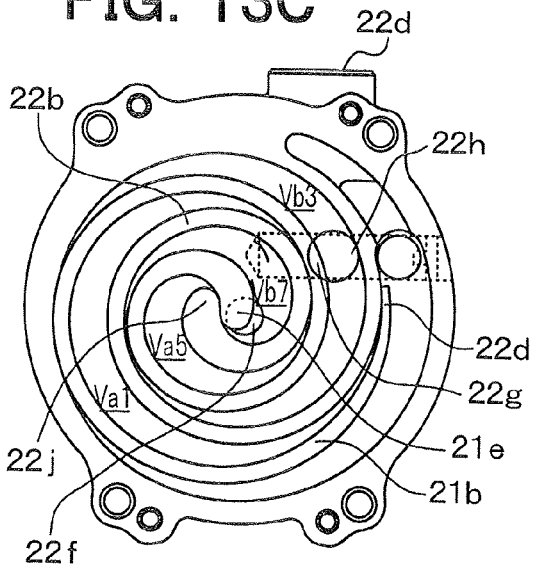

However, in the case of the compressor 10 of the present embodiment, as shown in FIG. 12, even when the middle displacement is reduced, the compression efficiency is still higher than the compression efficiency of the prior art compressor, in which the bypass ports 22*g*, 22*h* are symmetrically placed about the rotational center O of the orbiting scroll 21. FIG. 12 is a descriptive diagram for describing a relationship between the middle displacement and the compression efficiency of the compressor 10 in comparison to that of the prior art compressor.

Particularly, in the case where the main bypass port 22*h* is placed in the angular range, which is equal to or larger than −90 degrees and is equal to or smaller than 90 degrees, relative to the sub-bypass port 22*g*, it is possible to obtain sufficient compression efficiency in comparison to that of the prior art compressor. For example, the compression efficiency of the compressor 10 of the present embodiment at the time of operating the compressor 10 at the middle displacement of about 50% is generally the same as the compression efficiency of the prior art compressor at the time of operating the prior rat compressor at the middle displacement of about 65%.

As described above, in the case of the compressor 10 of the present embodiment, the power consumption reduction effect of the variable displacement compressor can be improved while limiting the reduction in the compression efficiency.

The stationary wrap 22*b* of the stationary scroll 22 of the present embodiment is configured such that the winding terminal end portion 22*i* of the stationary wrap 22*b* is extended to the winding terminal end portion 21*d* of the orbiting wrap 21*b* of the orbiting scroll 21, thereby implementing the asymmetrical spiral structure. In this way, it is possible to reduce a relative ratio of the middle displacement of the compressor 10 relative to the displacement at the time of operating the compressor 10 at the maximum displacement operational mode by increasing the displacement at the time of operating the compressor 10 at the maximum displacement operational mode instead of reducing the middle displacement of the compressor 10. Therefore, the power consumption reducing effect of the variable displacement scroll compressor can be improved while sufficiently limiting the reduction of the compression efficiency.

Furthermore, in the case where the two bypass ports 22*g*, 22*h* are symmetrically placed about the rotational center O of the orbiting scroll 21, the cylinder bore 27*a*, which forms the part of the opening and closing device (opening and closing means) 27, needs to be displaced from the refrigerant discharge port 22*f*, which is placed at or around the rotational center O of the orbiting scroll 21, so that the structure of the opening and closing device 27 is possibly complicated.

In comparison to this, according to the present embodiment, the main bypass port 22*h* opens at the location, which is on the side (the sub-bypass port 22*g* side) of the second imaginary line L2 where the sub-bypass port 22*g* is located, so that it is not required to displace the cylinder bore 27*a* of the opening and closing device (opening and closing means) 27 from the refrigerant discharge port 22*f*. Therefore, the opening and closing device (opening and closing means) 27, which opens or closes each of the bypass ports 22*g*, 22*h*, can be implemented with the simple structure.

Furthermore, in the present embodiment, each of the bypass ports 22*g*, 22*h* is placed adjacent to the suction chamber 22*e*, so that the heated refrigerant can be easily returned to the suction chamber 22*e* through each of the bypass ports 22*g*, 22*h*. Thus, the influence of the reduction in the density of the suctioned refrigerant at the compressor 10 becomes small, and thereby it is possible to limit the deterioration of the performance of the compressor 10.

Second Embodiment

Next, a second embodiment of the present invention will be described with reference to FIGS. 13A to 13D. FIGS. 13A to 13D are descriptive diagrams for describing an operation of a compressor 10 of the present embodiment. FIGS. 13A to 13D correspond to FIGS. 9A to 9D, respectively, of the first embodiment.

In the first embodiment, the main bypass port 22*h* is placed at the location where the first imaginary line L1 and the third imaginary line L3 coincide with each other, and the sub-bypass port 22*g* and the main bypass port 22*h* are formed as separate holes. In contrast, according to the present embodiment, the sub-bypass port 22*g* and the main bypass port 22*h* are formed as a common single hole, unlike the first embodiment. In the present embodiment, the description of the components, which are similar to those of the first embodiment, will be omitted or simplified.

In the present embodiment, as shown in FIGS. 13A to 13D, one circular hole is formed at a location, which is displaced about 360 degrees from the refrigerant return passage 22*l* in the stationary base plate 22*a* on the radially inner side of the refrigerant return passage 22*l*. The circular hole is circular in the plane of the stationary base plate 22*a*. A radially inner part of this circular hole, which is located on the radially inner side in the radial direction of the orbiting scroll 21, serves as the sub-bypass port 22*g*, and a radially outer part of this circular hole, which is located on the radially outer side in the radial direction of the orbiting scroll 21, serves as the main bypass port 22*h*.

Even with this structure, similar to the first embodiment, the compression of the fluid in the compression stroke becomes moderate (slower) at the time of operating the compressor 10 at the variable displacement operational mode, and thereby it is possible to limit the leakage of the refrigerant from each of the compression chambers Va, Vb. Thus, it is possible to limit the deterioration in the compression efficiency at the time of operating the compressor 10 at the variable displacement operational mode.

Furthermore, in the case of the present embodiment, in which the bypass ports 22*g*, 22*h* are integrated into the single circular hole, the processing of the bypass ports 22*g*, 22*h* at the time of forming the same can be eased. Thus, the manufacturing costs can be reduced.

However, with this construction, the two compression chambers Va, Vb, between which the pressure difference exists, are communicated with each other at the time of operating the compressor 10 at the maximum displacement operational mode. Therefore, it is required to provide a hole opening and closing device (hole opening and closing means), which closes the circular hole of the stationary base plate 22*a* at the time of operating the compressor 10 at the maximum displacement operational mode and opens the circular hole of the stationary base plate 22*a* at the time of operating the compressor 10 at the variable displacement operational mode. The hole opening and closing device (hole opening and closing means) may be, for example, a valve element, which is slidable in the circular hole of the stationary base plate 22*a* in the axial direction of the compressor 10 to close or open the circular hole.

Third Embodiment

Figure 14:
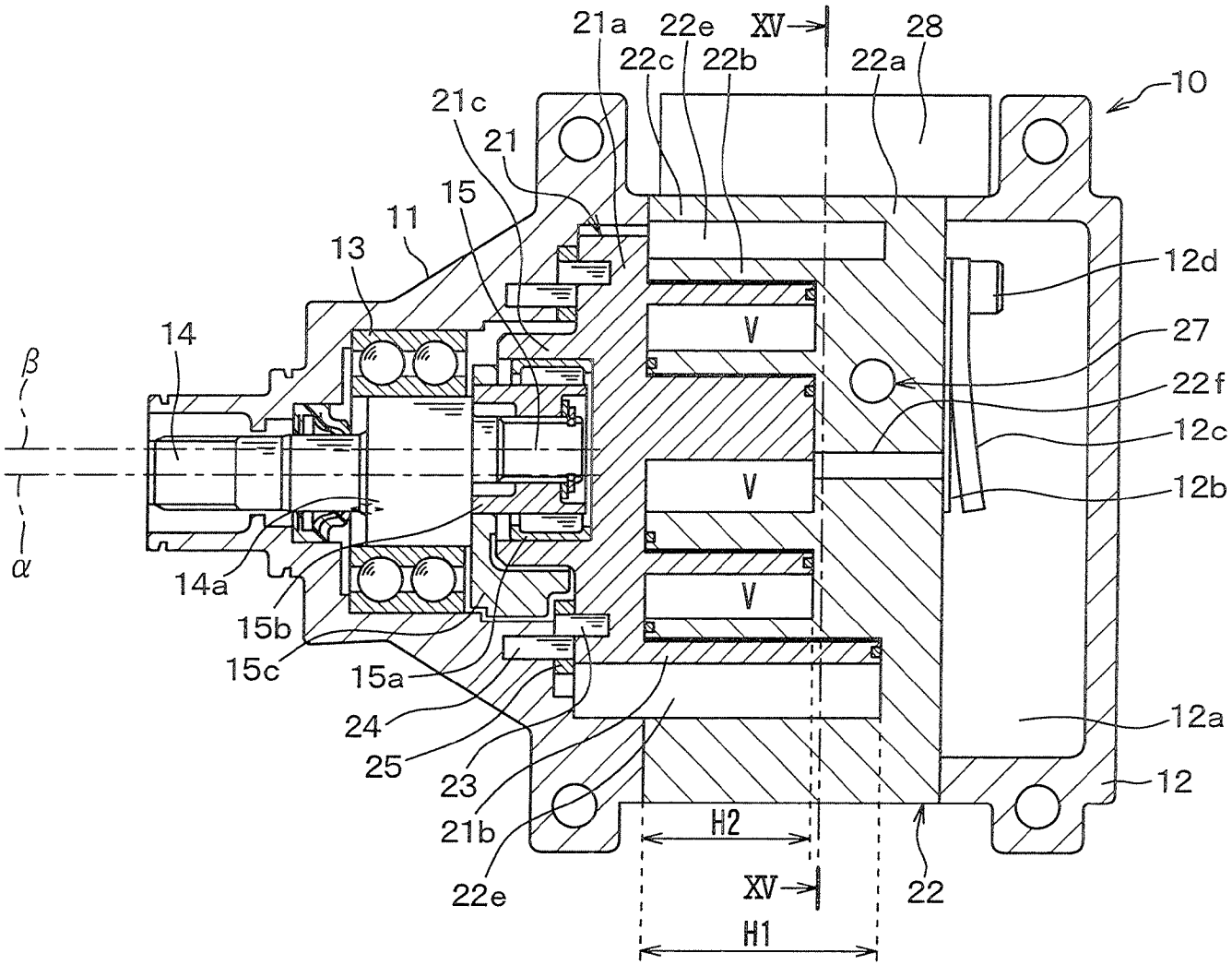
FIG. 14 is a longitudinal cross-sectional view of a variable displacement scroll compressor according to a third embodiment of the present invention.

Next, a third embodiment of the present invention will be described with reference to FIGS. 14 and 15. FIG. 14 is a longitudinal cross-sectional view of a compressor 10 of the present embodiment, and FIG. 15 is a cross-sectional view taken along line XV-XV in FIG. 14.

The compressor 10 of the present embodiment differs from the compressor 10 of each of the first and second embodiments with respect to the following point. That is, in the present embodiment, a volume of the radially outer compression chamber V, which is placed radially outer side at the scrolls 21, 22, is larger than a volume of the radially inner compression chamber V, which is placed radially inner side at the scrolls 21, 22, unlike the first and second embodiments. In the present embodiment, the description of the components, which are similar to those of the first and/or second embodiments, will be omitted or simplified.

Figure 15:
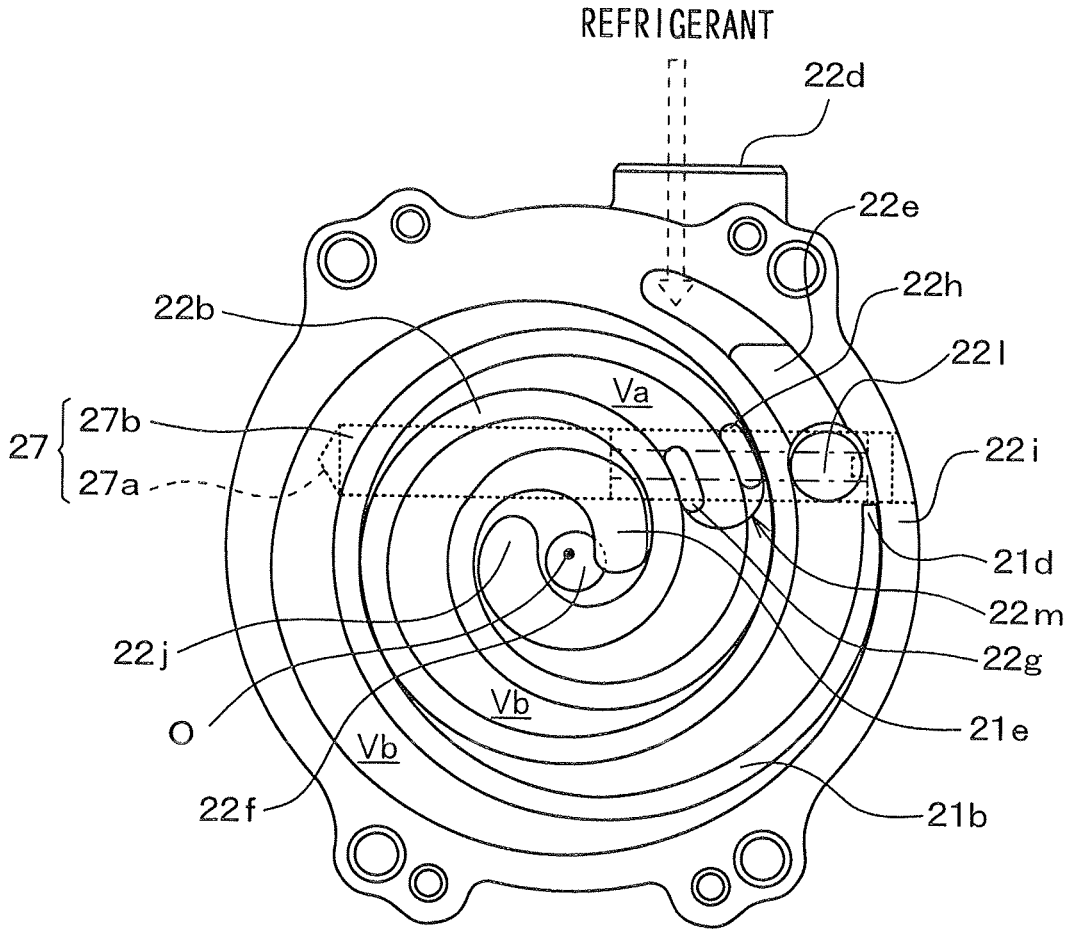
FIG. 15 is a cross-sectional view taken along line XV-XV in FIG. 14.

As shown in FIGS. 14 and 15, in the present embodiment, a step 22*m* is formed in the end surface of the stationary base plate 22*a*, from which the stationary wrap 22*b* projects, so that a projecting height (i.e., a height measured in the direction perpendicular to the end surface of the stationary base plate 22*a*) of one portion of the stationary base plate 22*a*, which is located on the refrigerant discharge port 22*f* side of the step 22*m* in the winding direction of the stationary wrap 22*b* becomes high. Furthermore, a projecting height of another portion of the stationary base plate 22*a*, which is located on the outer peripheral portion 22*c* side of the step 22*m* in the winding direction of the stationary wrap 22*b*, becomes low. The one portion of the stationary base plate 22*a*, which is opposed to the orbiting base plate 21*a* of the orbiting scroll 21 in the axial direction of the compressor 10 and is located on the refrigerant discharge port 22*f* side of the step 22*m* in the winding direction of the stationary wrap 22*b*, forms a shallow end surface portion of the stationary base plate 22*a*, which is shallow from the orbiting base plate 21*a* in the axial direction of the compressor 10. Furthermore, the another portion of the stationary base plate 22*a*, which is opposed to the orbiting base plate 21*a* of the orbiting scroll 21 in the axial direction of the compressor 10 and is located on the outer peripheral portion 22*c* side in the winding direction of the stationary wrap 22*b*, forms a deep end surface portion of the stationary base plate 22*a*, which is deep from the orbiting base plate 21*a* in the axial direction of the compressor 10.

A winding height (also referred to as a wrap height), i.e., a projecting height H1 of the stationary wrap 22*b* at the outer peripheral portion 22*c* side is higher than a winding height (also referred to as a wrap height), i.e., a projecting height H2 of the stationary wrap 22*b* at the refrigerant discharge port 22*f* side, while the projecting distal end portion of the stationary wrap 22*b*, which projects toward the orbiting base plate 21*a* side in the axial direction of the compressor 10, is aligned in a direction perpendicular to the axial direction of the compressor 10, i.e., is located at the same axial position along the extent of the stationary wrap 22*b* in the winding direction thereof.

In contrast, a winding height, i.e., a projecting height H1 of the orbiting wrap 21*b* at the radially outer side is higher than a winding height, i.e., a projecting height H2 of the orbiting wrap 21*b* at the radially inner side, while the projecting distal end portion of the orbiting wrap 21*b*, which projects toward the stationary base plate 22*a* in the axial direction of the compressor 10, contact the shallow end surface portion of the stationary base plate 22*a*, which is located at the refrigerant discharge port 22*f* side, and also the deep end surface portion of the stationary base plate 22*a*, which is located at the outer peripheral portion 22*c* side.

As discussed above, according to the present embodiment, the stationary wrap 22*b* of the stationary scroll 22 and the orbiting warp 21*b* of the orbiting scroll 21 are configured such that the winding height of the stationary wrap 22*b* measured from the stationary bass plate 22*a* and the winding height of the orbiting wrap 21*b* measured from the orbiting base plate 21*a* are increased at the radially outer side thereof in comparison to the radially inner side thereof. In this way, the volume of the compression chamber V at the radially outer side of the scrolls 21, 22 can be increased in comparison to the volume of the compression chamber V at the radially inner side of the scrolls 21, 22.

Here, the step 22*m*, which is formed in the stationary base plate 22*a*, is placed on the side of the sub-bypass port 22*g* where the distal end portion of the sub-bypass port 22*g* in the advancing direction of the orbiting scroll 21 is located. Specifically, the volume of the compression chamber V, which is located on the radially outer side of the sub-bypass port 22*g*, is larger than the volume of the compression chamber V, which is located on the radially inner side of the sub-bypass port 22*g*. Therefore, at the time of operating the compressor 10 at the variable displacement operational mode, the refrigerant of the compression chamber V having the large volume is returned to the suction chamber 22*e*, and the refrigerant of the compression chamber V having the small volume is compressed.

Thereby, the displacement of the compressor 10 at the time of operating the compressor 10 at the maximum displacement operational mode is increased without decreasing the displacement (middle displacement) of the compressor 10 at the time of operating the compressor at the variable displacement operational mode. Thus, it is possible to reduce the ratio of the middle displacement relative to the displacement of the compressor 10 at the time of operating the compressor 10 at the maximum displacement operational mode. Therefore, the power consumption reducing effect of the variable displacement scroll compressor can be improved while sufficiently limiting the reduction of the compression efficiency.

The various embodiments of the present invention have been described above. However, the present invention is not limited to the above embodiments, and the above embodiments may be modified within the scope and spirit of the present invention. For example, the above embodiments may be modified as follows.

(1) Although it is preferred to form the stationary wrap 22*b* and the orbiting wrap 21*b* into the asymmetrical spiral structure, the stationary wrap 22*b* and the orbiting warp 21*b* may be modified as follows. That is, the stationary wrap 22*b* and the orbiting wrap 21*b* may be configured into a symmetrical spiral structure such that the winding terminal end portion 22*i* of the stationary wrap 22*b* and the winding terminal end portion 21*d* of the orbiting wrap 21*b* are opposed to each other about the rotational center O.

Figure 3C:
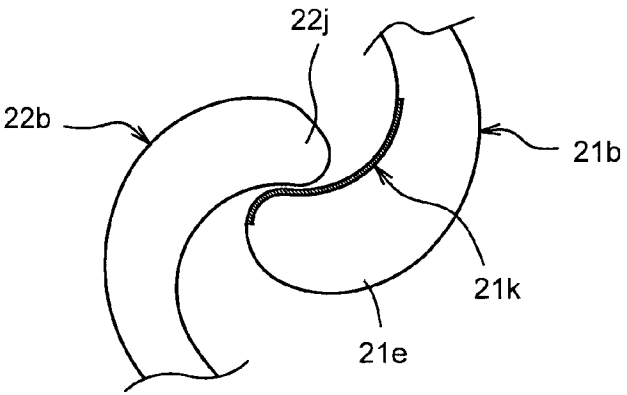
FIG. 3C is a descriptive diagram for describing a wrap clearance of an orbiting wrap of an orbiting scroll of a variable displacement compressor in a modification of the first embodiment.

(2) In each of the above embodiments, the wrap clearance 22*k* is formed in the winding start end portion 22*j* of the stationary wrap 22*b*. Alternatively, a wrap clearance, which is similar to the wrap clearance 22*k*, may be formed in the winding start end portion 21*e* of the orbiting wrap 21*b*, as shown in FIG. 3C, which indicates a modification of the first embodiment.

(3) In each of the first and third embodiments, each of the sub-bypass port 22*g* and the main bypass port 22*h* is formed as the elongated hole, which is elongated in the plane of the stationary base plate 22*a*. Alternatively, each of the sub-bypass port 22*g* and the main bypass port 22*h* may be formed as a circular hole in each of the first and third embodiments. Further alternatively, multiple circular holes may be combined to form each of the sub-bypass port 22*g* and the main bypass port 22*h*.

(4) In each of the above embodiments, the opening and closing device (serving as the opening and closing means) 27, which is adapted to open and close each of the sub-bypass port 22*g* and the main bypass port 22*h*, is constructed to include the spool valve element 27*b*. Alternatively, as long as each of the sub-bypass port 22*g* and the main bypass port 22*h* can be opened and closed, any other device (element) may be used as the opening and closing device or the opening and closing means.

(5) In each of the above embodiments, the wrap clearance 22*k* is formed in the stationary wrap 22*b* of the stationary scroll 22. Alternatively, a wrap clearance, which is similar to the wrap clearance 22*k*, may be formed in the orbiting wrap 21*b* of the orbiting scroll 21.

(6) In each of the above embodiments, the rotation limiting mechanism includes the rotation limiting pins 23, 24 and the ring member 25. However, the structure of the rotation limiting mechanism is not limited to this. For example, the rotation limiting mechanism may alternatively include a known Oldham's ring or ball coupling to limit the rotation (self-rotation) of the orbiting scroll 21 about the center thereof.

(7) The variable displacement scroll compressor of the present invention is not limited to the compressor, which is driven by the vehicle drive engine through the drive force conducting device (drive force conducting means), such as the V-belt, the pulley or the electromagnetic clutch. For example, the variable displacement scroll compressor of the present invention may be implemented as an electric compressor, which is driven by an electric motor.

(8) The variable displacement scroll compressor of the present invention is not limited to the refrigerant compressor of the vehicle air conditioning system. That is, the variable displacement scroll compressor of the present invention may be implemented as a compressor of any suitable device or system to compress corresponding fluid within the scope and spirit of the present invention.

Additional advantages and modifications will readily occur to those skilled in the art. The invention in its broader terms is therefore not limited to the specific details, representative apparatus, and illustrative examples shown and described.

What is claimed is:

1. A variable displacement scroll compressor comprising:

a stationary scroll that includes:

a first base plate; and a stationary wrap that is spirally wound in a winding direction thereof along a plane of the first base plate and projects from the first base plate in a direction generally perpendicular to the plane of the first base plate;

an orbiting scroll that includes:

a second base plate; and an orbiting wrap that is spirally wound in a winding direction thereof along a plane of the second base plate and projects from the second base plate toward the first base plate in a direction generally perpendicular to a plane of the second base plate, wherein the stationary wrap and the orbiting wrap contact with each other to define first and second compression chambers between the stationary wrap and the orbiting wrap;

a suction chamber that is formed in a radially outermost portion of the orbiting scroll and is configured to supply fluid to each of the first and second compression chambers; and a fluid discharge port that is formed in a center portion of the first base plate and is configured to discharge the fluid from each of the first and second compression chambers toward an outside of the variable displacement compressor upon compression of the fluid in each of the first and second compression chambers, wherein:

the first base plate includes:

a first bypass hole that is configured to communicate between the suction chamber and the first compression chamber, which is defined between an outer peripheral wall surface of the stationary wrap and an inner peripheral wall surface of the orbiting wrap; and a second bypass hole that is configured to communicate between the suction chamber and the second compression chamber, which is defined between an inner peripheral wall surface of the stationary wrap and an outer peripheral wall surface of the orbiting wrap;

a rotational center of the orbiting scroll, about which the orbiting scroll revolves, and the first bypass hole is located along a first imaginary line in the plane of the first base plate;

the rotational center of the orbiting scroll is also located along a second imaginary line, which is perpendicular to the first imaginary line in the plane of the first base plate;

the second bypass hole opens at a corresponding location of the first base plate, which is on a side of the second imaginary line where the first bypass hole is located in the plane of the first base plate, so that timing of communicating between the suction chamber and the first compression chamber with each other through the first bypass hole is deviated from timing of communicating between the suction chamber and the second compression chamber with each other through the second bypass hole;

the rotational center of the orbiting scroll and the second bypass hole are located along a third imaginary line, which defines an interior angle of equal to or smaller than 90 degrees relative to the first imaginary line in the plane of the first base plate;

the first compression chamber and the second compression chamber are communicating with each other to discharge the fluid of the first compression chamber and the fluid of the second compression chamber through the fluid discharge port when a rotational angle of the orbiting scroll is in a merge reference angle;

the first bypass hole is formed at a corresponding location of the first base plate, at which the first bypass hole contacts the orbiting wrap when the orbiting scroll is advanced to revolve along the first base plate in an advancing direction and is placed within a predetermined angular range, which is equal to or larger than −90 degrees and is equal to or smaller than 0 degrees relative to the merge reference angle in the plane of the first base plate;

one of the stationary wrap and the orbiting wrap has a wrap clearance that is recessed in the inner peripheral wall surface of the one of the stationary wrap and the orbiting wrap to have a reduced wrap wall thickness in a winding start end portion of the one of the stationary wrap and the orbiting wrap at a location adjacent to the fluid discharge port: and the first bypass hole is closed by the orbiting wrap when the fluid is leaked from the second compression chamber into the first compression chamber through the wrap clearance.

2. The variable displacement scroll compressor according to claim 1, further comprising opening and closing means for opening and closing each of the first bypass hole and the second bypass hole, wherein a displacement of the variable displacement scroll compressor is variable through opening or closing of each of the first bypass hole and the second bypass hole with the opening and closing means.

3. The variable displacement scroll compressor according to claim 1, wherein:

the first bypass hole and the second bypass hole are separately formed relative to each other;

the first bypass hole is sized such that the first bypass hole is closable with a corresponding contact portion of the orbiting wrap, which contacts the first base plate, to disconnect communication between the suction chamber and the first compression chamber; and the second bypass hole is sized such that the second bypass hole is closable with a corresponding contact portion of the orbiting wrap, which contacts the first base plate, to disconnect communication between the suction chamber and the second compression chamber.

4. The variable displacement scroll compressor according to claim 1, wherein:

the stationary wrap has an extended portion, which is extended to lengthen a winding terminal end portion of the stationary wrap to a winding terminal end portion of the orbiting wrap;

an inner peripheral wall surface of the extended portion of the stationary wrap is a curved surface that is continuous from another portion of the inner peripheral wall surface of the stationary wrap, which is other than the extended portion of the stationary wrap; and the first compression chamber and the second compression chamber are asymmetrical to each other.

5. The variable displacement scroll compressor according to claim 1, wherein:

an outer portion of the stationary wrap, which is located on an outer side in the winding direction of the stationary wrap, has a projecting height that is measured from the first base plate In the direction generally perpendicular to the plane of the first base plate and is larger than that of an inner portion of the stationary wrap, which is located on an inner side of the outer portion of the stationary wrap in the winding direction of the stationary wrap; and an outer portion of the orbiting wrap, which is located on an outer side in the winding direction of the orbiting wrap, has a projecting height that is measured from the second base plate in the direction generally perpendicular to the plane of the second base plate and is larger than that of an inner portion of the orbiting wrap, which is located on an inner side of the outer portion of the orbiting wrap in the winding direction of the orbiting wrap.

6. The variable displacement scroll compressor according to claim 1, wherein the first bypass hole and the second bypass hole are located between a predetermined part of the inner peripheral wall surface of the stationary wrap and a predetermined part of the outer peripheral wall surface of the stationary wrap, which are adjacent to each other and are directly radially opposed to each other in the stationary wrap.

7. The variable displacement scroll compressor according to claim 1, wherein a maximum depth of the wrap clearance, which is measured in the direction perpendicular to the inner peripheral wall surface of the one of the stationary wrap and the orbiting wrap, is in a range of 0.2 mm to 0.4 mm.

8. The variable displacement scroll compressor according to claim 1, wherein:

the first bypass hole is located on one side of the fluid discharge port, which is opposite from the winding start end portion of the stationary wrap in a radial direction of the fluid discharge port, in the plane of the first base plate; and the first bypass hole extends along an outer peripheral surface of a first turn of the stationary wrap, which starts from the winding start end portion of the stationary wrap.

* * * * *